US007354337B2

(12) United States Patent
Fujita

(10) Patent No.: US 7,354,337 B2
(45) Date of Patent: Apr. 8, 2008

(54) PAD CONDITIONER, PAD CONDITIONING METHOD, AND POLISHING APPARATUS

(75) Inventor: Takashi Fujita, Mitaka (JP)

(73) Assignee: Tokyo Seimitsu Co., Ltd., Mitaka-shi, Tokyo (JP)

( * ) Notice: Subject to any disclaimer, the term of this patent is extended or adjusted under 35 U.S.C. 154(b) by 0 days.

(21) Appl. No.: 11/467,240

(22) Filed: Aug. 25, 2006

(65) Prior Publication Data

US 2008/0003930 A1 Jan. 3, 2008

(30) Foreign Application Priority Data

Aug. 30, 2005 (JP) ..... 2005-249968

(51) Int. Cl.
*B24B 21/18* (2006.01)

(52) U.S. Cl. ..... 451/443; 451/527; 451/529

(58) Field of Classification Search ..... 451/56, 451/443, 527, 529, 531, 534
See application file for complete search history.

(56) References Cited

U.S. PATENT DOCUMENTS

| | | | | |
|---|---|---|---|---|
| 5,525,100 | A * | 6/1996 | Kelly et al. | 451/527 |
| 5,885,147 | A * | 3/1999 | Kreager et al. | 451/443 |
| 6,126,533 | A * | 10/2000 | Johnson et al. | 451/527 |
| 6,623,344 | B2 | 9/2003 | Inaba | |
| 6,953,390 | B2 | 10/2005 | Sakurai et al. | |
| 2003/0134580 | A1* | 7/2003 | Sakurai et al. | 451/56 |
| 2003/0190874 | A1* | 10/2003 | So | 451/56 |
| 2005/0282477 | A1* | 12/2005 | Butterfield et al. | 451/443 |
| 2006/0035568 | A1* | 2/2006 | Dunn | 451/56 |
| 2006/0046623 | A1* | 3/2006 | Wang et al. | 451/56 |
| 2006/0105680 | A1* | 5/2006 | Jeong | 451/11 |

FOREIGN PATENT DOCUMENTS

| | | | |
|---|---|---|---|
| JP | 61-180644 | A | 8/1986 |
| JP | 62-184972 | U | 11/1987 |
| JP | 7-100749 | A | 4/1995 |
| JP | 10-315117 | A | 12/1998 |
| JP | 10-329003 | A | 12/1998 |
| JP | 2000-79551 | A | 3/2000 |
| JP | 2002-515833 | A | 5/2002 |
| JP | 2003-181756 | A | 7/2003 |

OTHER PUBLICATIONS

Japanese Office Action dated Nov. 5, 2007 issued for the corresponding Japanese Application and enclose a copy of the Japanese Office Action with the English Translation thereof.

* cited by examiner

*Primary Examiner*—Eileen P. Morgan
(74) *Attorney, Agent, or Firm*—David S. Safran

(57) ABSTRACT

The present invention provides: a pad conditioner for dressing a surface of a polishing pad which is used in a polishing apparatus for polishing works, comprising a bending or deflecting or elastic member and a supporting section to support a base end of the bending or deflecting or elastic member, wherein upon contact of a vicinity of a tip end of the bending or deflecting or elastic member with the polishing pad, the bending or deflecting or elastic member elastically deforms, so that a pressure necessary to condition the pad is generated; a polishing apparatus using the pad conditioner; and a pad conditioning method using the same, in order to evenly condition a polishing pad of an elastic body by following a surface of the polishing pad.

13 Claims, 17 Drawing Sheets

PAD CONDITIONER, PAD CONDITIONING METHOD, AND POLISHING APPARATUS

BACKGROUND OF THE INVENTION

1. Field of the Invention

The present invention relates to a pad conditioner, a pad conditioning method, and a polishing apparatus, in particular, a pad conditioner which recovers a surface of a polishing pad in a polishing apparatus for polishing a work such as a semiconductor wafer, a pad conditioning method, and a polishing apparatus which is provided with the pad conditioner.

2. Description of the Related Art

As microstructure and multilayered structure of a semiconductor device have been achieved, CMP (Chemical Mechanical Polishing) technology has become essential in a manufacturing process of the semiconductor device. The CMP technology is now used for planarization of an insulating film between layers, as well as in various processes of Cu wiring and isolation of elements, for example.

In the CMP technology for planarization, removal rate uniformity (polishing uniformity) across a work surface is an important specification. In order to improve the polishing uniformity, it is important to uniformly distribute any elements which affect the removal rate across a work surface.

While such important elements include a polishing pressure and a relative velocity in polishing, a surface state of a polishing pad is also an important element quantification of which is still in a preliminary stage. A preferable surface state of a polishing pad is achieved by conditioning the polishing pad. Also, a fact that, in a so-called in-situ conditioning in which a pad is conditioned during polishing, for example a stopping of the conditioning suddenly drops a removal rate, shows that a precise control of a surface state of a polishing pad is important.

Pad conditioning is an act to bring a pad conditioner (hereinafter, it may be simply referred to as a conditioner) having grinders such as diamond into contact with a polishing pad to scrape or roughen a surface of the polishing pad, so that a surface state of a new polishing pad is optimized as an initial state with a good holding capacity of the slurry or the slurry holding capacity of the polishing pad in use is recovered to maintain its polishing capability.

Conventionally, pad conditioners having diamond abrasive particles electro-deposited thereto have been often used to condition a polishing pad by being pressed against the polishing pad while rotating around its central axis (for example, see Japanese Patent Application Laid-Open No. 2001-274122, or Japanese Patent Application Laid-Open No. 2003-181756).

FIG. 12 is a conceptual view to illustrate a pad conditioner described in Japanese Patent Application Laid-Open No. 2001-274122: The pad conditioner 130 described in Japanese Patent Application Laid-Open No. 2001-274122 includes, as shown in FIG. 12, a substrate 131 having diamond abrasive particles 133 electro-deposited thereto, and a supporting section 132 to which the substrate 131 is fixedly attached.

FIG. 13 is a conceptual view to illustrate a pad conditioner described in Japanese Patent Application Laid-Open No. 2003-181756. The pad conditioner 130A described in Japanese Patent Application Laid-Open No. 2003181756 in principle includes a substrate 131A, diamond abrasive particles 133 which are electro-deposited to the substrate 131A, and a supporting section 132A, and the substrate 131A is swingably mounted to the supporting section 132A in every direction, via a so-called gimbal arrangement of a ball joint 132*a* for example, so as to follow a surface of a polishing pad 20.

Apparatuses having a brush conditioner in addition to a diamond conditioner are also known (for example, see Japanese Patent Application Laid-Open No. 2003-211355). Japanese Patent Application Laid-Open No. 2003-211355 discloses a diamond conditioner for scraping a polishing pad surface as a first conditioner and a brush conditioner for extracting foreign matters clogged in recesses in the polishing pad surface as a second conditioner.

Since the brush conditioner is for extracting foreign matters clogged in recesses in the polishing pad surface, it is the diamond conditioner of the first conditioner which conditions the pad.

The brush conditioner has a nylon brush as a brushing member. The nylon brush can brush a pad surface, but is not effective for scraping the pad surface.

Thus, in the technology disclosed in the above document, the brush conditioner is used as a device only for removing foreign matters in a pad surface, not for scraping and conditioning the pad surface with a brush.

Other than the above, there is another document which describes about conditioning by use of brush (for example, see the above Japanese Patent Application Laid-Open No. 2003-181756 or Japanese Patent Application Laid-Open No. 10-329003). However, both brushes described in Japanese Patent Application Laid-Open No. 2003-181756 and Japanese Patent Application Laid-Open No. 10-329003, as well as the one in Japanese Patent Application Laid-Open No. 2003-211355, are described to use in a brushing method for extracting foreign matters in a pad surface, not to use in a conditioning method for scraping a surface of a polishing pad.

SUMMARY OF THE INVENTION

A polishing pad used in a CMP apparatus has a surface which is not flat when the pad is attached to a polishing plate, because the thickness of the polishing pad itself is uneven or the polishing pad is attached to the polishing plate unevenly. A surface of a polishing pad attached to a polishing plate usually has a height difference of 30 μm to 50 μm.

However, in CMP, in order to uniformly polish a wafer surface, a uniform conditioning over a polishing pad surface having such unevenness is required by following such a surface with a pad conditioner.

FIG. 11 is a view to show a concept of a pad conditioning specification required in CMP. As shown in FIG. 11, when a polishing pad 20 having the waviness with a height difference of 50 μm for a width of about 100 mm is conditioned for example, a uniform conditioning by following the waviness is required. Since a polishing pad is made of an elastic material in this way, such a pad conditioning in a CMP apparatus is considered to be a reference grinding process on an elastic material.

Whereas, the pad conditioner 130 described in Japanese Patent Application Laid-Open No. 2001-274122 is completely fixed to the supporting section 132, and this configuration allows only the top portion of a waviness of a polishing pad surface to be scraped. So, the pad conditioner 130 has a problem that a uniform conditioning by following a polishing pad surface cannot be achieved.

The pad conditioner 130A described in Japanese Patent Application Laid-Open No. 2003-181756 has a conditioning surface which is supported to follow a polishing pad surface, but in an actual pad conditioning, a uniform conditioning by following a polishing pad surface cannot be achieved. This is because the pad conditioner is positioned at an angle to the polishing pad 20 due to a large frictional force applied to the pad conditioner surface in contact with the polishing pad 20 which is moving at a high speed. The positioning at an angle makes the frictional force to be decreased, and the pad conditioner returns to its original posture, thereby the pad conditioner discontinuously contacts the polishing pad 20 (stick-slip).

The following problems on the polishing performance of the wafer are caused by the ununiformity (unevenness) of the conditioning in the polishing pad surface. The polishing ununiformity (polishing unevenness) is occurred because there are a conditioned portion and an unconditioned portion in the polishing pad surface. Next, in the step of stabilizing the polishing rate, the entire polishing pad surface is not conditioned evenly and the conditioning is made to partially progress, so that stabilizing the polishing rate takes long time. The polishing pad in which the polishing rate is yet stabilized, can not subject a product wafer to the polishing processing. As a result, the startup time of the polishing pad takes long.

In case of pad conditioning is an act to bring the conventional plate type pad conditioner to which diamonds are electro-deposited into contact with a polishing pad, the pad conditioner is positioned at an angle to the polishing pad due to a large frictional force applied to the pad conditioner surface in contact with the polishing pad which is moving at a high speed. The positioning at an angle makes the frictional force to be decreased, and the pad conditioner returns to its original posture, thereby the pad conditioner discontinuously contacts the polishing pad. In this way, the conditioning of the polishing pad in a circumferential direction is performed unevenly. The problems caused by the uniformity of the conditioning are not limited to the above described.

The size of the scrapes of the polishing pad scraped by conditioning varies greatly, since the portions of small scrapes and large scrapes are generated because the pad conditioner discontinuously contacts the polishing pad. The surface of the polishing pad is scraped as exfoliated a big pieces not stably scraped by small amount, accordingly, the scrapes volume of the polishing pad by the conditioning enlarges. As a result, the consumption amount of the pad surface is increased, leading to a problem that the life of the polishing pad is short and then the replacement cycle of the polishing pad is also short. In this way, conventional pad conditioners have an essential problem in their structures from the point of view of a reference grinding over an elastic body.

Prior to the present invention, the inventor of the present invention made a study to assess the effect of a pad conditioning. First, a recovery of a removal rate of a clogged polishing pad was evaluated by brushing a surface of the polishing pad with a nylon brush while pure water being supplied to the pad without scraping the polishing pad surface. As a result, the removal rate recovered not more than 31.4% in spite of the pure water supply and brushing for a long time of period, where it was observed under SEM that foreign matters in the polishing pad surface were completely removed from the polishing pad surface (related document: Daichi Kamikawa and Takashi Fujita et. al., Proceedings of the 2004 Japan Society for Precision Engineering Conference, Tohoku Regional Branch, p. 22).

The above experiment shows that such a brushing only removes foreign matters remained in a surface of a polishing pad, but does not condition a pad. The inventor of the present invention confirmed that the removal rate recovers with a usual conditioning using diamonds for scraping the polishing pad surface after the brushing, and concluded that a scraping of a polishing pad surface is necessary for a pad conditioning.

In addition, the inventor of the present invention verified that a surface of a polishing pad is chemically modified when a removal rate of the polishing pad is decreased due to clogging. The inventor of the present invention also confirmed that scraping the diverse material partially recovers the removal rate. This result suggests that a removal rate decreases not only when foreign matters are deposited in pores of a polishing pad, but also when the polishing pad surface chemically modifies (related document: Takashi Fujita, Proceedings of the 2005 Japan Society for Precision Engineering Conference, Spring, p. 845).

In this way, the inventor of the present invention confirmed that extracting foreign matters in a polishing pad surface is not sufficient as a conditioning to maintain a removal rate, and scraping the modified pad surface is essential.

A conditioning in terms of scraping a polishing pad surface is already achieved with a conditioning plate of the first conditioner to which diamonds are electro-deposited, in the above Japanese Patent Application Laid-Open No. 2003-211355 for example.

The above description shows that a pad conditioning which includes scraping a polishing pad surface by following a surface of the polishing pad, that is, finely grinding the polishing pad is indispensable.

However, a pad conditioning is not just a scraping of a polishing pad surface Roughening the polishing pad surface during the scraping is also necessary, and when the surface is carved with a tool such as a plane without roughening, the slurry holding capacity of the polishing pad is degraded, which is not a result of conditioning to obtain. In conditioning, it is important to scrape a pad surface while a microscopically rough surface being formed which is required to improve or maintain the slurry holding capability of the pad.

When a finely-scraped, microscopically rough surface of a polishing pad is achieved by conditioning, the modified portion of the polishing pad surface is effectively removed, and a substantial surface area for holding slurry is increased in the polishing pad surface, which allows a sufficiently high removal rate to be ensured.

Because the polishing pad is an object to be processed which is made of a polymer composite resin material and of a material having a number of air bubbles in its surface, the process to achieve a microscopically rough surface of a polishing pad is very different from a grinding in a usual metal processing or ceramic processing. In grinding a porous resin material with abrasive particles, a size of the abrasive particles, a tip shape of the abrasive particles, and the like should be carefully designed so as not to tear off the surface by the particles cutting into the surface.

In a conventional pad conditioning, a plate to which diamonds are electro-deposited is pressed against a polishing pad. As a result, a polishing pad surface is scraped by the moving diamonds of the plate. However, since the diamonds electro-deposited to the plate do not cut into the pad enough under a low pressure, a somewhat higher pressure is applied to press down the plate for conditioning. Therefore, the plate roughens a polishing pad surface while grinding, but eventually it scrapes the surface too much due to the higher presser, and shortens the life of the polishing pad.

Prior to the present invention, the inventor of the present invention first roughened a polishing pad surface with a tool having a tiny needle to which diamonds are electro-deposited. The inventor confirmed a result that the surface was quite effectively scraped, and observed under SEM that the surface was effectively microscopically roughened despite the surface of the polishing pad being also a porous resin material.

However, as described above, in the case of a conditioner using a conventional conditioning plate, the conditioning plates is positioned at an angle to a polishing pad due to a frictional force between the polishing pad and the conditioner, and the positioning at an angle makes the frictional force to be decreased, and the pad conditioner returns to its original posture, thereby a conditioning is performed by the pad conditioner which discontinuously contacts the polishing pad.

With respect to the discontinuous contact, a report about an actual research has been issued (See Ara philipossian, Zhonglin Li, Hyosang Lee, Len Borucki, Ryozo Kimura, Naoki Rikita and Kenji Nagasawa, Effect of Diamond Disc Conditioner Design and Kinematics on Process Hydrodynamics during Copper CMP, Proceedings of CMP-MIC conference (2005) p. 43, T. P. Merchanr, J. N. Zabasajja, L. J. Borucki, A. Scott Lawing, A Pad Wear Model For CMP Process Optimization, Proceedings of CMP-MIC Conference (2005) p. 143-150).

In the report, a tilting of a pad is mentioned in which a conditioner tilts relative to a pad due to a frictional force when a small vertical load is applied to a conditioner, and the moving of a conditioning plate is analyzed in consideration of the tilting.

The inventor of the present invention also conditioned a pad using a conditioning plate of the prior art under a flexible joint mechanism. In the conditioning, the inventor of the present invention applied a coating over the polishing pad surface to evaluate the conditioning uniformity based on the amount of the removed coating.

The result of the above evaluation, as shown in FIG. 9, clearly shows that the polishing pad surface was unevenly conditioned using the conventional conditioning mechanism. This obviously means that the polishing pad surface was unevenly polished because the conditioner discontinuously contacted the pad as described above and also the uneven thickness of the polishing pad or uneven attachment of the polishing pad affected the polishing.

The present invention was made in the view of the above problems and in light of the background which is based on a number of the above examinations, and the objects of the present invention is to provide a pad conditioner which, in conditioning a polishing pad of a polishing apparatus such as a CMP apparatus, is able to evenly condition the surface of the polishing pad, reduce the startup time of the pad conditioner, have excellent removal rate uniformity across a work surface, and prolong the life of the polishing pad, and a polishing apparatus using the pad conditioner.

In order to achieve the above object of the present invention, a first aspect according to the present invention provides a pad conditioner for dressing a surface of a polishing pad which is used in a polishing apparatus for polishing works, comprising: an bending or deflecting or elastic member; and a supporting section to support a base end of the bending or deflecting or elastic member, wherein upon contact of a vicinity of a tip end of the bending or deflecting or elastic member with the polishing pad, the bending or deflecting or elastic member elastically deforms, so that a pad conditioning of the polishing pad is performed by scraping a surface of the polishing pad with the vicinity of the tip end of the bending or deflecting or elastic member pressed against the surface of the polishing pad at a predetermined pad conditioning pressure.

According to the first aspect of the present invention, because, upon contact of the vicinity of the tip end of the elastic member with the polishing pad, the elastic member is elastically deformed and a conditioning pressure is generated so that the elastic member conditions the surface of the polishing pad with its tip end, the tip end follows the surface of the polishing pad, which can achieve a uniform pad conditioning along the surface of the polishing pad.

In the present invention, as described in a second aspect, the bending or deflecting or elastic member is a brush like member made of a metal and the vicinity of the tip end of the brush like member is preferably coated with a wear resistant material, or as described in a third aspect of the present invention, a tip piece is fixed to the vicinity of the tip end of the bending or deflecting or elastic member, and the tip piece is preferably made of a material having high hardness and wear resistance.

According to the second and the third aspects of the present invention, a polishing pad can be efficiently conditioned with the brush like member made of a metal in which the vicinity of the tip end of the brush like member is preferably coated with a wear resistant material or the tip piece made of a material having high hardness and wear resistance.

In the present invention, as described in a fourth aspect, the bending or deflecting or elastic member may be a thin plate having a vicinity of a tip end to which a plurality of the tip pieces are fixed. In the present invention, as described in a fifth aspect, the tip end of the bending or deflecting or elastic member preferably has a plurality of notches formed therein toward to the base end, so that the tip end is divided into a plurality of portions.

According to the fifth aspect of the present invention, because the bending or deflecting or elastic member has a tip end to which a plurality of tip pieces are fixed, and the tip end of the bending or deflecting or elastic member is divided into a plurality of portions, even when some individual portions discontinuously contact a polishing pad like a stick-slip motion in an actual pad conditioning, taken as a whole, a constant conditioning on the polishing pad is performed by the bending or deflecting or elastic member, which enables a uniform pad conditioning along a surface of the polishing pad.

In the present invention, as described in a sixth aspect, the bending or deflecting or elastic member may be consisted of a group of a plurality of linear bodies, and as described in a seventh aspect, each of the plurality of linear bodies preferably has a tip end to which the tip piece is fixed.

According to the seventh aspect of the present invention, because the bending or deflecting or elastic member comprises a group of a plurality of linear bodies, and each linear body has a tip end to which a tip piece is fixed, even when some individual tip pieces of the linear bodies discontinuously contact a polishing pad like a stick-slip motion in an actual pad conditioning, taken as a whole, a constant conditioning on the polishing pad is performed by the bending or deflecting or elastic member, which enables a uniform pad conditioning along a surface of the polishing pad.

An eighth aspect of the present invention provides the pad conditioner according to any one of the first to seventh aspects, further comprising a pressure regulating device which regulates a pad conditioning pressure by moving the supporting section to or away from the polishing pad and adjusting a bending of the bending or deflecting or elastic member.

According to the eighth aspect of the present invention, because the pad conditioner is provided with a pressure regulating device which regulates a pad conditioning pressure by adjusting a bending of the bending or deflecting or elastic member, a pad can be conditioned under an optimal condition.

A ninth aspect of the present invention provides the pad conditioner according to the eighth aspect, wherein the supporting section includes a first supporting body for fixing the base end of the bending or deflecting or elastic member thereto, and a second supporting body which is mounted to the first supporting body movably to and from the first supporting body for limiting the position of the bending or deflecting or elastic member in a plane parallel to the polishing pad, and the bending or deflecting or elastic member has an effective flexible length which is adjustable by moving the second supporting body to or away from the first supporting body.

According to the ninth aspect of the present invention, because the bending or deflecting or elastic member is configured to have an adjustable effective flexible length, a pressure for the pad conditioning can be easily regulated.

A tenth aspect of the present invention provides a polishing apparatus comprising the pad conditioner according to any one of the first to ninth aspects, According to the tenth aspect of the present invention, because of the pad conditioner which is able to uniformly condition a pad along a surface of the polishing pad, a process on a work can be well achieved with excellent removal rate uniformity across a work surface.

An eleventh aspect of the present invention provides a pad conditioning method for dressing a surface of a polishing pad which is used in a polishing apparatus for polishing works, comprising: conditioning the polishing pad while pure water or slurry being supplied to the polishing pad by relatively moving the polishing pad and the pad conditioner according to the first aspect with the polishing pad and the pad conditioner being in contact to each other.

According to the eleventh aspect of the present invention, because, upon contact of the vicinity of the tip end of the bending or deflecting or elastic member with the polishing pad, the bending or deflecting or elastic member is elastically deformed and a conditioning pressure is generated so that the bending or deflecting or elastic member conditions the surface of the polishing pad with its tip end, the tip end follows the surface of the polishing pad, which can achieve a uniform pad conditioning along the surface of the polishing pad.

A twelfth aspect of the present invention provides a pad conditioning method for dressing a surface of a polishing pad which is used in a polishing apparatus for polishing works, comprising: using the pad conditioner according to the ninth aspect of the present invention; moving the second supporting body to or away from the first supporting body to adjust an effective flexible length of the bending or deflecting or elastic member; and regulating a pressure which is necessary for the pad conditioning.

According to the twelfth aspect of the present invention, because a pressure for pad conditioning is regulated by adjusting an effective flexible length of the bending or deflecting or elastic member, the pressure for the pad conditioning can be easily regulated.

A thirteenth aspect of the present invention provides a pad preparation method for conditioning a surface of a polishing pad which is used in a polishing apparatus for polishing works to optimize the surface as an initial state for polishing, comprising: scraping the surface of the polishing pad to roughen the surface of the polishing pad by relatively moving the polishing pad and the pad conditioner with the polishing pad and the pad conditioner according to the first aspect being in contact to each other.

According to the thirteenth aspect of the present invention, because a surface of a polishing pad is roughened by contacting the tip end of the bending or deflecting or elastic member with the polishing pad to elastically deform the bending or deflecting or elastic member so that a pressure is generated, and scraping the surface of the polishing pad with the tip end of the bending or deflecting or elastic member, the tip end follows the surface of the polishing pad, which can achieve a uniform pad preparation along the surface of the polishing pad in a short time of period.

A fourteenth aspect of the present invention provides a pad preparation apparatus for conditioning a surface of a polishing pad which is used in a polishing apparatus for polishing works to optimize the surface as an initial state for polishing, comprising: a rotating table which holds and rotates the polishing pad; and the pad conditioner according to any one of the first to ninth aspects of the present invention, and wherein the pad preparation apparatus is configured to roughen the surface of the polishing pad by relatively moving the polishing pad and the pad conditioner with the polishing pad and the pad conditioner being in contact to each other, and by scraping the surface of the polishing pad.

According to the fourteenth aspect of the present invention, because a surface of a polishing pad is roughened by contacting the tip end of the bending or deflecting or elastic member with the polishing pad to elastically deform the bending or deflecting or elastic member so that a pressure is generated, and scraping the surface of the polishing pad with the tip end of the bending or deflecting or elastic member, the tip end follows the surface of the polishing pad, which can achieve a uniform pad preparation along the surface of the polishing pad in a short time of period.

As described above, according to a pad conditioner and a pad conditioning method of the present invention, uniform pad conditioning can be achieved along a polishing pad surface, and also according to a polishing apparatus of the present invention, a process on a work can be well achieved with excellent removal rate uniformity across a work surface.

DETAILED DESCRIPTION OF THE PREFERRED EMBODIMENTS

Figure 1:
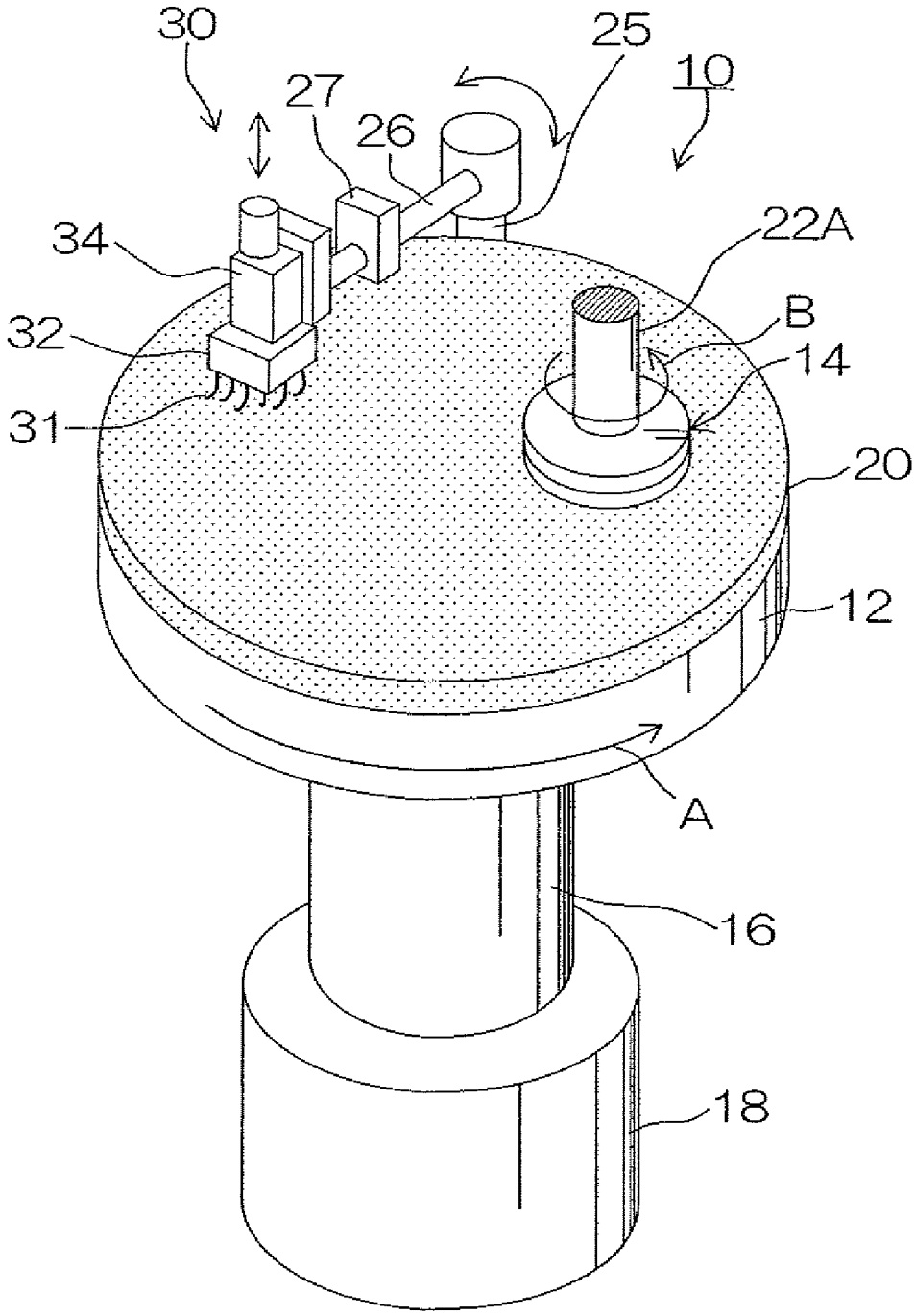
FIG. 1 is a perspective view to show an embodiment of a polishing apparatus according to the present invention.

Now, preferable embodiments of a pad conditioner and a polishing apparatus according to the present invention will be explained below in detail with reference to the accompanying drawings. Throughout the drawings, similar reference numerals or characters are used to designate the similar members.

FIG. 1 is a perspective view to show an embodiment of a polishing apparatus according to the present invention. A polishing apparatus 10 of FIG. 1 generally includes a polishing plate 12, a wafer carrier 14, and a pad conditioner 30.

The polishing plate 12 has a rotating shaft 16, and a driving of a motor 18 which is coupled to the rotating shaft 16 causes the polishing plate 12 to rotate in a direction shown by the arrow A in FIG. 1. The wafer carrier 14 holding a work of wafer has a rotating shaft 22A, and a driving of a motor (not shown) which is coupled to the rotating shaft 22A causes the wafer carrier 14 to rotate in a direction shown by the arrow B in FIG. 1. The polishing plate 12 has an upper surface onto which a polishing pad 20 is attached, and slurry is supplied from a slurry supply nozzle (not shown) over the polishing pad 20.

The pad conditioner 30 conditions a surface of the rotating polishing pad 20 after being pressed against to the surface to maintain its polishing capability, by cleaning clogging of the polishing pad 20 so that the slurry holding capacity of the polishing pad is recovered.

Figure 2A:
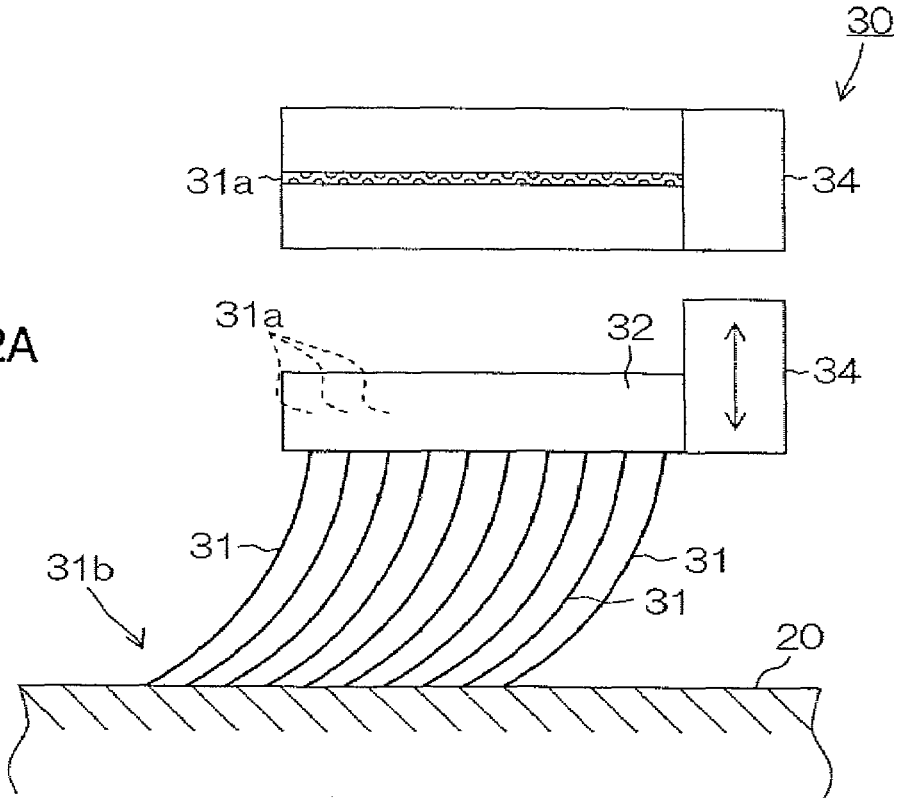
FIGS. 2A and 2B are conceptual views to show a first embodiment of a pad conditioner according to the present invention.
Figure 2B:
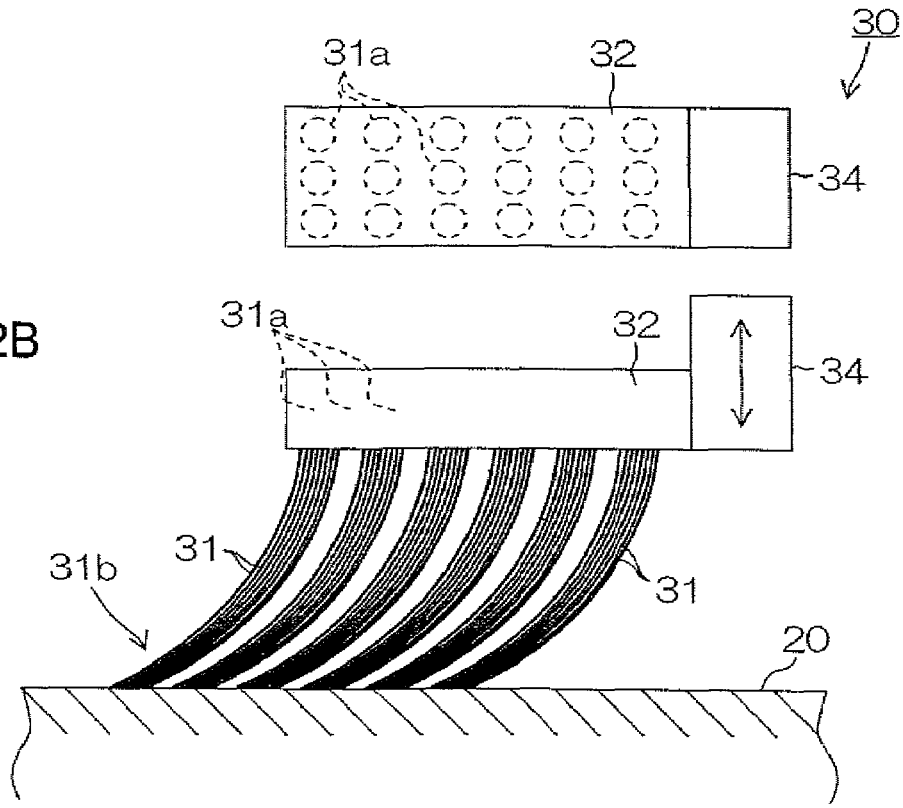

FIGS. 2A and 2B are conceptual views to show a pad conditioner 30 of the first embodiment of the present invention. The pad conditioner 30 generally includes an elastic member 31, and a supporting section 32 which supports a base end 31*a* of the elastic member 31. The supporting section 32 is supported by a pressure regulating device 34 which moves to and away from the polishing pad 20.

The elastic member 31 may be preferably stainless, duralumin, brass, or a group (for example, a brush-like group) of a linear metal having high hardness and wear resistance.

The tip end 31*b* of the elastic member 31 is preferably formed to have a sharp edge and coated with a material having high hardness and wear resistance.

The material having high hardness and wear resistance may be DLC (Diamond Like Carbon), cemented carbide, and the like as well as diamond abrasive particles, and the material may be fixed to the elastic member by CVD (Chemical Vapor Deposition), coating, and the like as well as plating such as electro-deposition.

As shown in FIG. 2A, the supporting section 32 may be consisted of two members for various approaches including sandwiching or adhesively holding the base end 31*a* of the elastic member 31 therebetween, or as shown in FIG. 2B, implanting the plurality of the base ends 31*a* of the elastic members 31 in each hole provided on the supporting section 32. The pressure regulating device 34 may include a guide member (not shown), a screw member which is driven by a motor, and the like, but other driving mechanism may be used.

Figure 7:
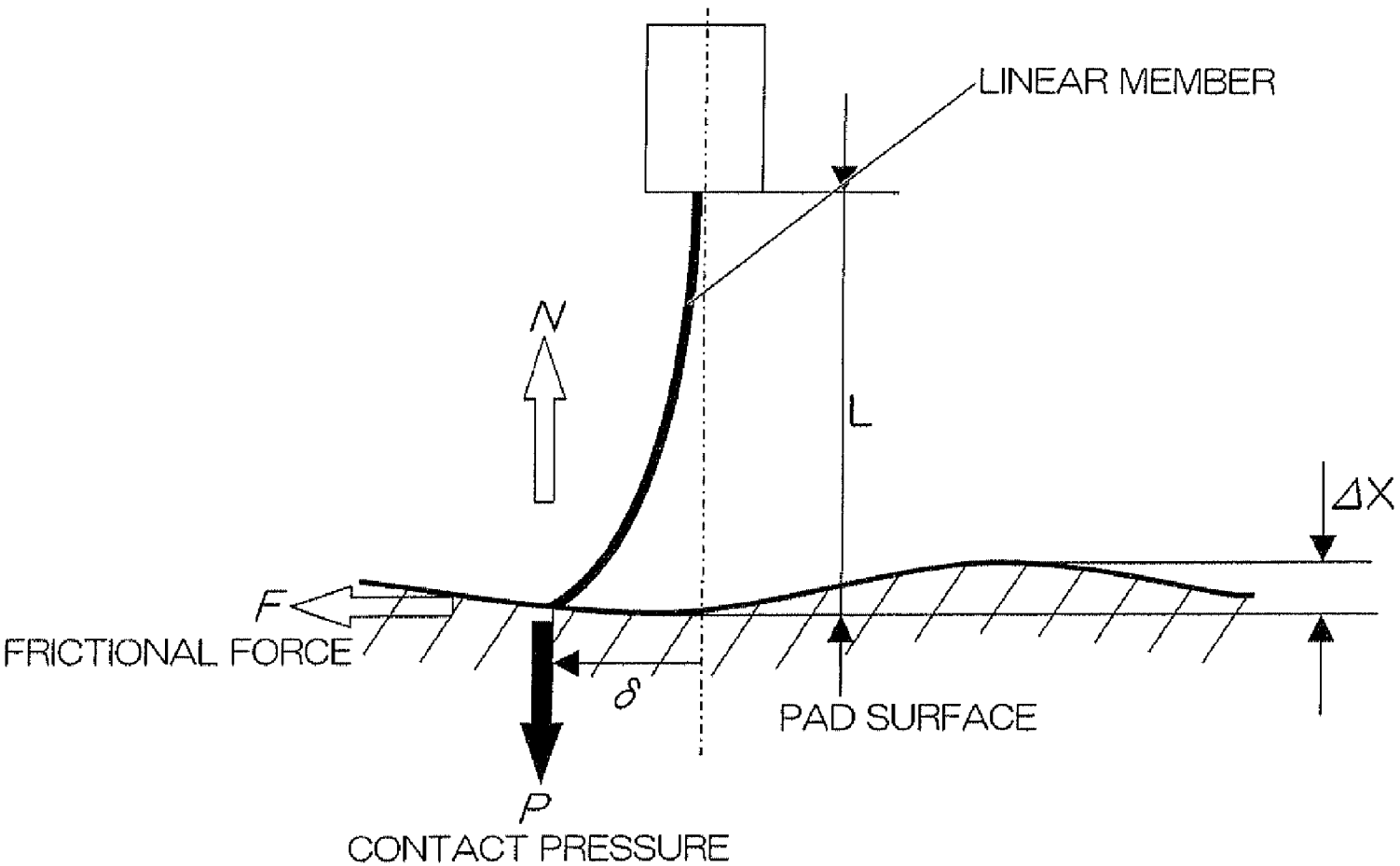
FIG. 7 is a schematic view to show a conditioning by a pad conditioner of the present invention.

FIG. 7 is a schematic view to show a conditioning by a pad conditioner 30 according to the present invention. A conditioning pressure which is applied by the pad conditioner 30 can be represented by the following formula (I), where a Young's modulus of the elastic member 31 is E, an effective flexible length of the elastic member 31 is L, a thickness of the elastic member 31 is t, a width of the elastic member 31 is b, a coefficient of friction between the elastic member 31 and the polishing pad 20 is μ, and a horizontal displacement caused by deflection of the elastic member 31 is δ.

$$P = \frac{Ebt^3\delta}{6(\delta^2 + L^2)(\mu L + \delta)} \tag{1}$$

For example, when a surface waviness of the polishing pad 20 is ±50 μm, the use of an elastic member 31 having a Young's modulus E=101 Gpa, a thickness t=0.4 mm, a width b=0.3 mm, and an effective length L=30 mm yields the conditioning pressure P=20±0.076 gf, and yields the variation in pressures on the order of 0.4% or less due to the height difference of the polishing pad 20.

In addition to the capability of the elastic member 31 to follow a surface of the polishing pad 20, the individual displacement and movement of each abrasive particle supported by the elastic member 31 allows the elastic member 31 to constantly condition the polishing pad 20 in a stable manner as a whole.

In FIGS. 2A and 2B, in order to condition the polishing pad 20, the tip piece 33 of the pad conditioner 30 is brought into contact with the surface of the rotating polishing pad 20, and then the supporting section 32 is approached to the polishing pad 20 by a predetermined distance so that the elastic members 31 are bended. The elastic deformation of the elastic members 31 creates a conditioning pressure which makes the surface of the polishing pad 20 to be conditioned. In this case, the amount of bending of the elastic members 31 can be adjusted by the pressure regulating device 34 to obtain an optimal conditioning pressure.

The tip piece 33 follows the different heights of the surface of the polishing pad 20 caused by the surface waviness, and a stress variation which corresponds to a variation of bending of the elastic members 31 caused by the following is small, thereby a more uniform conditioning along the surface of the polishing pad 20 can be achieved.

Since the elastic member 31 is consisted of an group of individual linear body, even when the tip end 31*b* of each elastic member 31 discontinuously contacts the polishing pad 20 like a stick-slip motion individually, as the entire group of the plurality of elastic members 31, at any time, some tip ends 31*b* of the plurality of elastic members 31 are in contact with the polishing pad 20, which can achieve a uniform pad conditioning along a surface of the polishing pad 20.

As shown in FIG. 1, the pad conditioner 30 is mounted to an arm 26 which is fixed to a rotating shaft 25 and includes a transfer medium 27, and is moved in a reciprocating manner between a central portion and a peripheral portion of the polishing pad 20 to condition the polishing pad 20 or, by the transfer medium 27, is moved in a reciprocating manner in a radius direction of the polishing pad 20 in which the elastic member 31 is arranged, which can improve the uniformity of conditioning across the polishing pad surface.

Figure 3:
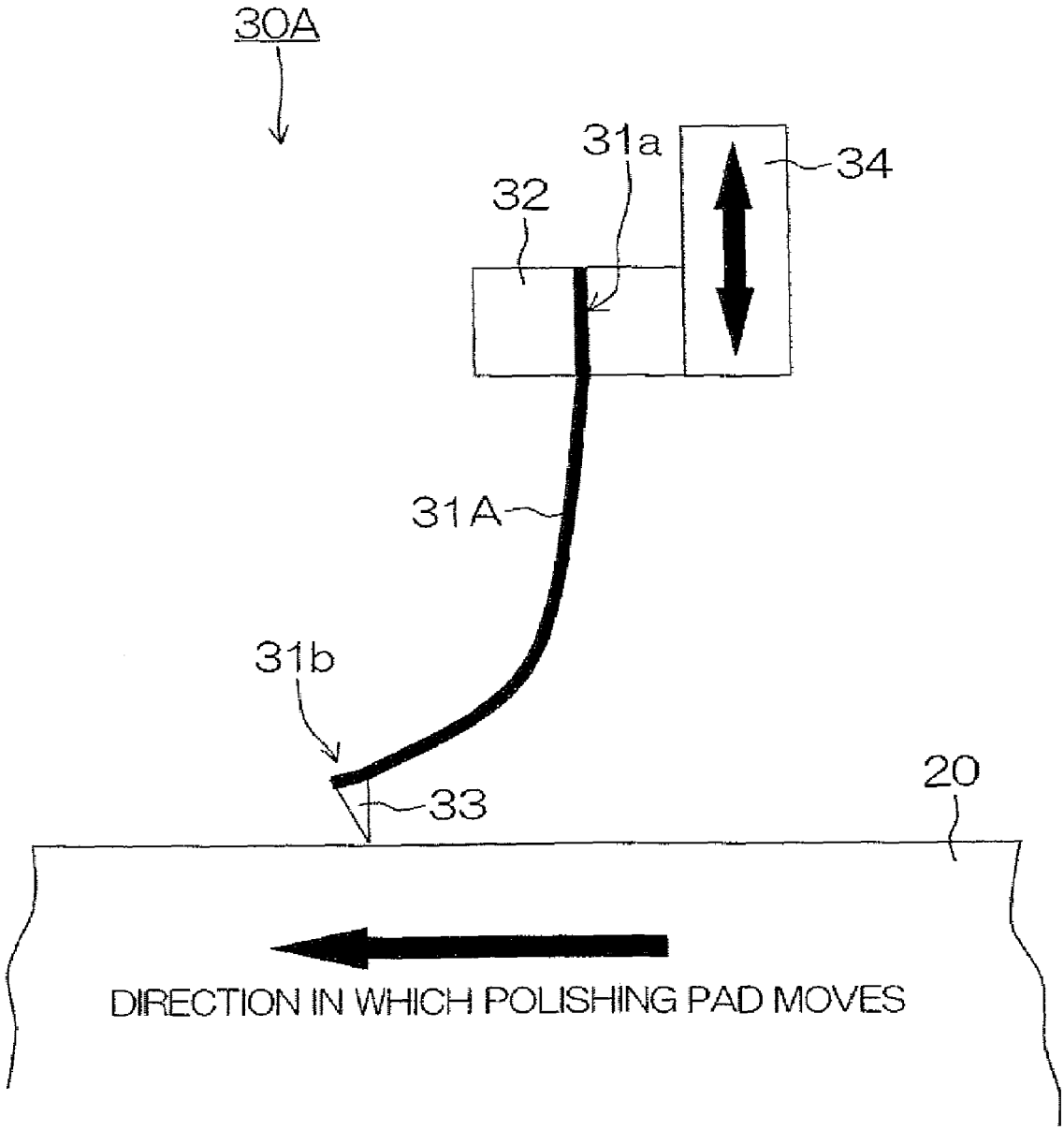
FIG. 3 is a conceptual view to show a second embodiment of a pad conditioner according to the present invention.

FIG. 3 is a conceptual view to show a pad conditioner 30 of the second embodiment of the present invention. The pad conditioner 30A generally includes an elastic member 31A, and a supporting section 32 which supports a base end 31*a* of the elastic member 31A. The elastic member 31A also has a vicinity of a tip end 31*b* to which a tip piece 33 is fixedly attached. The supporting section 32 is supported by a pressure regulating device 34 which moves to and away from the polishing pad 20.

The elastic member 31A may be preferably a plate spring, a piano wire and the like. The tip piece 33 fixedly attached to the vicinity of the tip end 31*b* of the elastic member 31A is preferably made of a material having high hardness and wear resistance, and diamond abrasive particles or the like are fixed to the tip piece 33 by electro-deposition.

Figure 4:
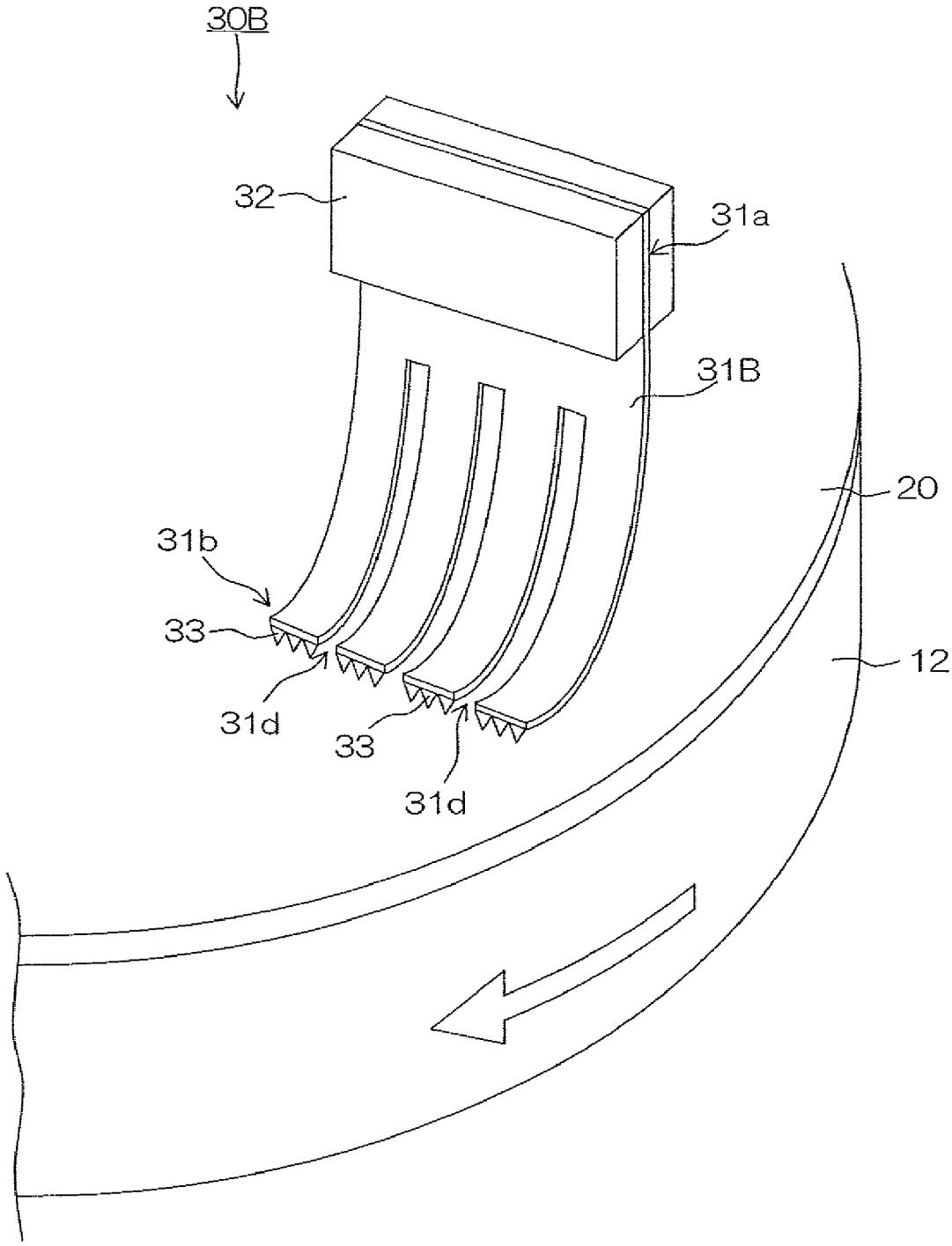
FIG. 4 is a conceptual view to show a third embodiment of a pad conditioner according to the present invention.

FIG. 4 is a conceptual perspective view to show a third embodiment of a pad conditioner 30B according to the present invention. The pad conditioner 30B according to the first embodiment includes a thin sheet of a plate spring 31B for the elastic member 31B.

The plate spring 31B has a plurality of notches 31*d* formed therein from the tip end 31*a* toward the base end 31*b* of the plate spring 31B to divide the tip end 31*b* into a plurality of portions. The plurality of divided portions have tips to which tip pieces 33 of diamond abrasive particles are electro-deposited respectively.

As described above, the material having high hardness and wear resistance may be DLC (Diamond Like Carbon), cemented carbide, and the like as well as diamond abrasive particles, and the material may be fixed to the elastic member by CVD (Chemical Vapor Deposition), coating, and the like as well as plating such as electro-deposition.

The pad conditioner 30B is, as shown in FIG. 4, configured so that a conditioning pressure is generated by the tip pieces 33 when the plate spring 31B is elastically deformed in order to condition the surface of the polishing pad 20 by the tip pieces 33.

As shown in FIG. 4, since the plate spring 31B has a plurality of notches 31*d* formed therein to divide tip end 31*b* into a plurality of portions from the positions close to the base end 31*a* to the tip end 31*b*, even when some individual tip pieces 33 discontinuously contact the polishing pad 20 like a stick-slip motion, as the entire plate spring 311B, at any time, some tip pieces 33 are in contact with the polishing pad 20, which achieves a uniform pad conditioning along a surface of the polishing pad 20.

Figure 5:
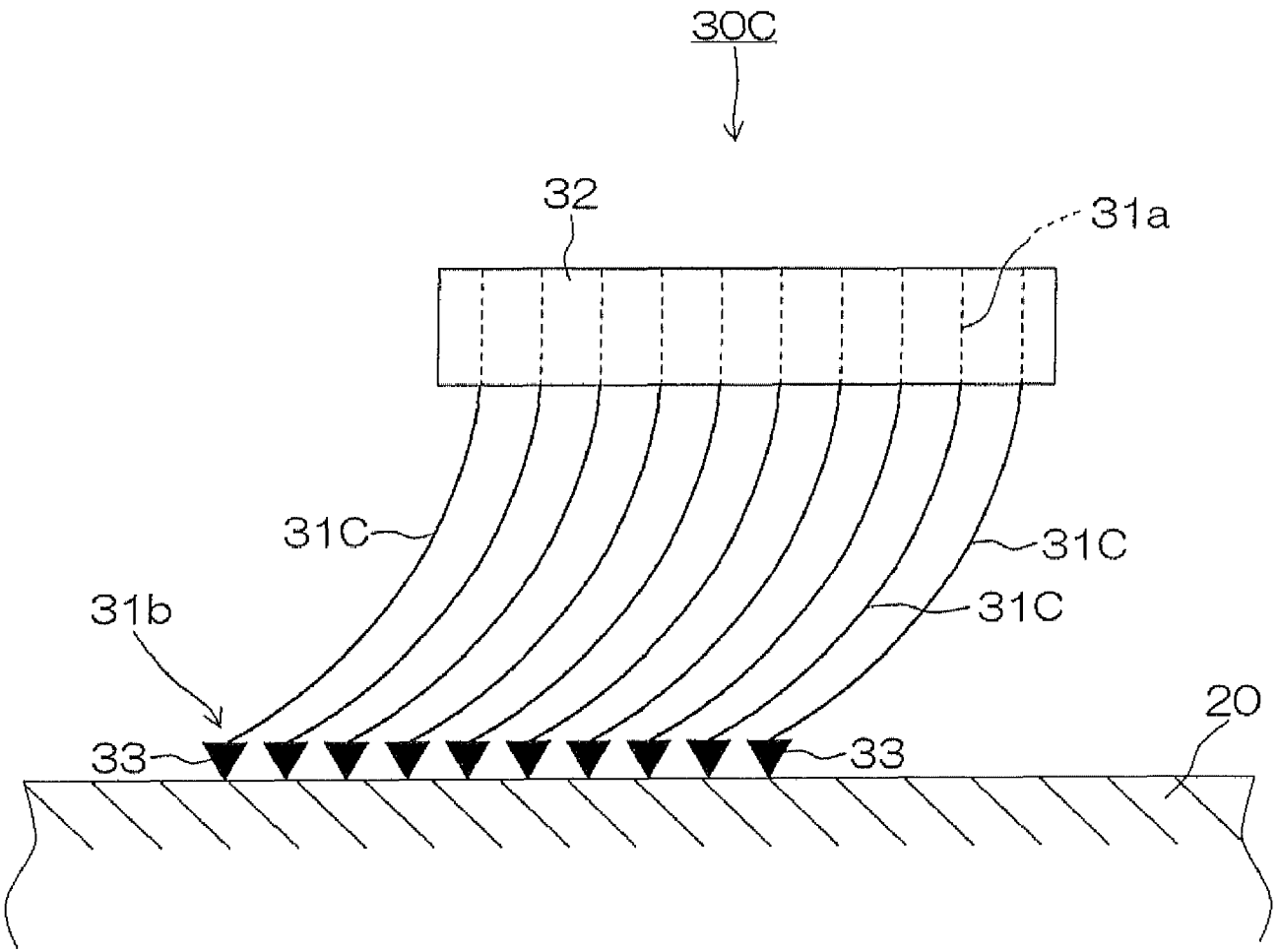
FIG. 5 is a conceptual view to show a fourth embodiment of a pad conditioner according to the present invention.

FIG. 5 is a conceptual view to show a fourth embodiment of a pad conditioner 30 according to the present invention. A pad conditioner 30B according to the fourth embodiment includes a group (for example, a brush-like group) of piano wires 31C, which are a plurality of linear bodies, for the elastic members 31.

A piano wire 31C which is the individual linear body has a base end 31*a* which is fixed to the supporting section 32 and a vicinity of a tip end 31*b* to which tip pieces 33 of diamond abrasive particles are electro-deposited. As shown in FIG. 5, with each piano wire 31C being elastically deformed, each tip piece 33 is brought in contact with the polishing pad 20 so that an appropriate conditioning pressure is generated.

Since the elastic member 31 is consisted of a group of individual piano wires 31C, in this third embodiment also, even when the tip pieces 33 of each piano wire 31C discontinuously contacts the polishing pad 20 like a stick-slip motion individually, as the entire group of the plurality of piano wires 31C, at any time, some tip pieces 33 of the plurality of piano wires 31C are in contact with the polishing pad 20, which achieves a uniform pad conditioning along a surface of the polishing pad 20.

In this fourth embodiment, the piano wires 31C are used as linear bodies, but the present invention is not limited to the piano wires, and any other linear bodies of materials having high modulus of elasticity may be used such as glass fibers, resin, and the like. In the case of materials such as glass fibers, resin, and the like, since it is hard to electro-deposit the tip pieces 33 to the materials, the tip pieces 33 may be fixedly attached with an adhesive and the like.

Figure 6:
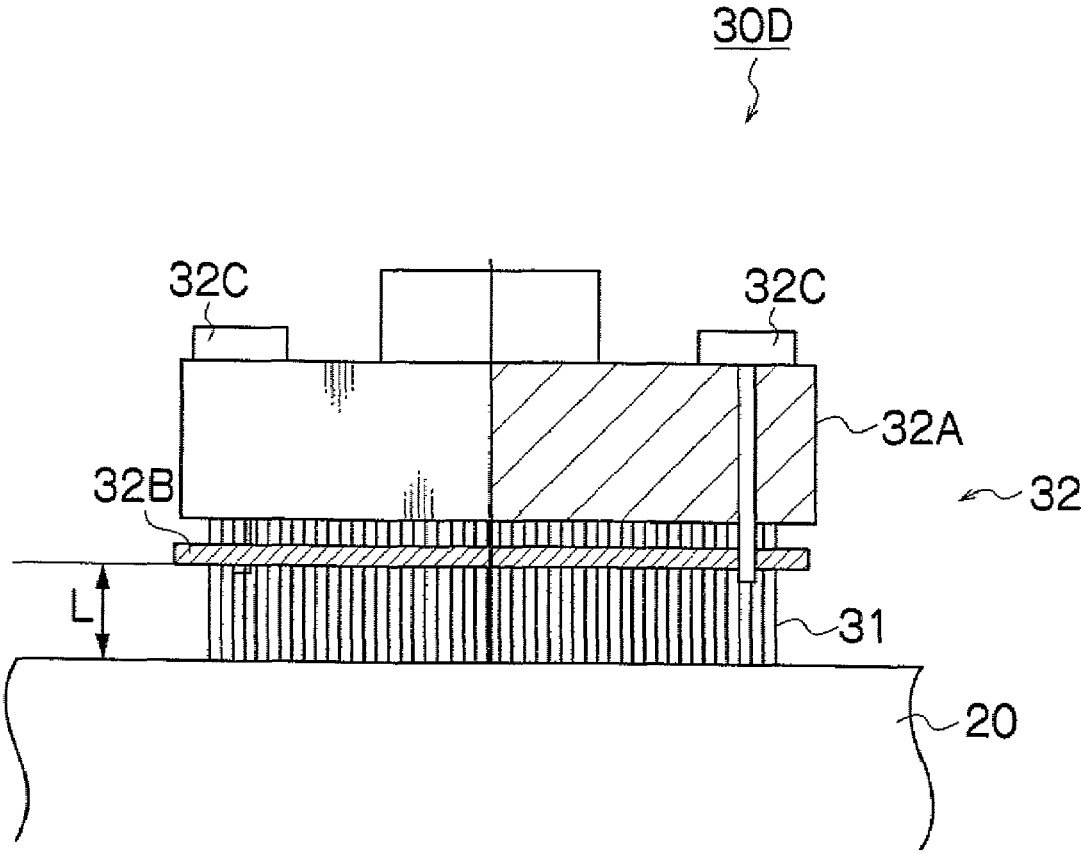
FIG. 6 is a conceptual view to show a fifth embodiment of a pad conditioner according to the present invention.

FIG. 6 is a conceptual view to show a fifth embodiment of a pad conditioner 30 according to the present invention. A pad conditioner 30D according to the fourth embodiment includes a supporting section 32 having a first supporting body 32A and a second supporting body 32B.

The first supporting body 32A is a member to fix each base end 31*a* of a plurality of elastic members 31 thereto, and limits the position of each elastic member 31 in a horizontal direction with a plurality of holes formed in the second supporting body 32. The second supporting body 32B is movably supported to and away from the first supporting body 32A with a plurality of adjustment screws 32C, so that the elastic members 31 can have an effective flexible length L which is finely adjusted.

This configuration of the pad conditioner 30D according to the fifth embodiment makes the adjustment of the effective flexible length L of the elastic members 31 easy, and so the fine control of the conditioning pressure P is easy.

As an elastic member 31 according to the fifth embodiment, the elastic member 31 in FIGS. 2A and 2B, the elastic member 31A in FIG. 3, the elastic member 31B in FIG. 4, or the elastic member 31C in FIG. 5 is preferably used.

Figure 8:
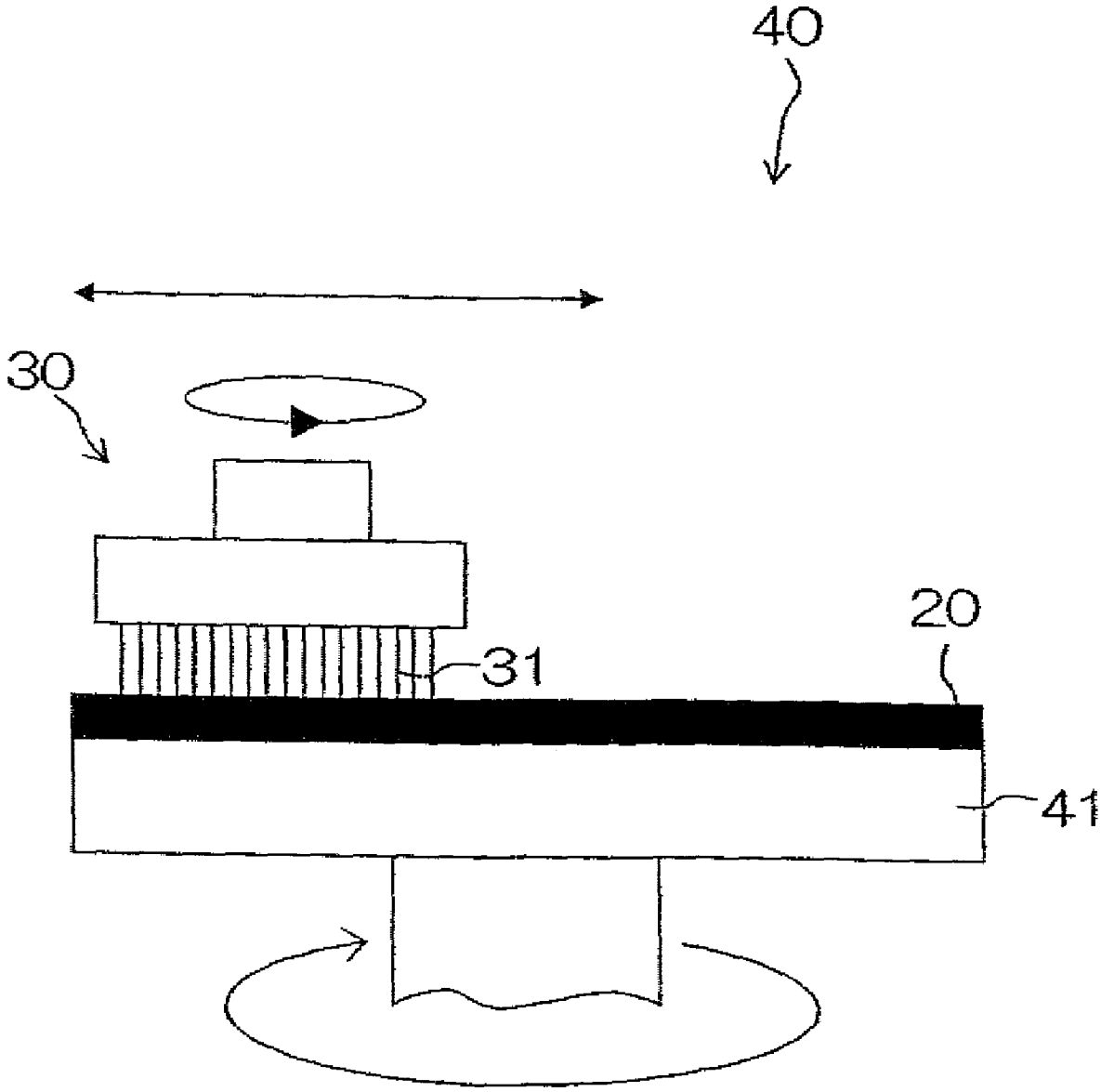
FIG. 8 is a top plan view to show an embodiment of a pad preparation apparatus according to the present invention.

FIG. 8 shows a pad preparation apparatus for optimizing a surface of the polishing pad 20 as an initial state for polishing by conditioning the polishing pad 20. A pad preparation apparatus 40 includes a rotating table 41 which holds and rotates the polishing pad 20, a pad conditioner 30, and a water or slurry supplying apparatus (not shown).

The rotating table 41 has a suction hole to suck and fix the polishing pad 20, and is rotated by a motor (not shown). The pad preparation apparatus 40 includes the pad conditioner 30 described above, and the polishing pad 20 and the pad conditioner 30 are brought into contact with each other while being rotated in order to finely scrape a surface of the polishing pad 20 and roughen the surface of the polishing pad 20. To achieve a microscopically rough surface of the polishing pad 20, water may be supplied to the polishing pad 20 during the roughening.

In conditioning, for example, a foamed polyurethane pad is used as the polishing pad 20, which is fixed to the rotating table 41 by vacuum suction. A process of conditioning is performed to obtain a surface roughness Ra of 0.4 μm to 0.6 μm at a rotation frequency of the polishing pad 20 of 30 rpm and a rotation frequency of the pad conditioner 30 of 80 rpm.

In this way, the pad preparation apparatus 40 includes the pad conditioner 30 described above, so that a uniform pad conditioning can be achieved, and a surface of the polishing pad 2v can be optimized as an initial state for polishing in a short time of period.

EXAMPLE

Now, examples of the pad conditioner 30 in the first embodiment will be described below. The elastic member 31 was made of SUS304 material having a diameter of 0.3 mm, an effective length of 20 mm and Young's modulus 193 GPa, and a diamond abrasive particle (particle size #60) was not electro-deposited to the vicinity of the tip end of the elastic member 31 as the tip piece 33. About 500 elastic members 31 were fixed into the circular plate of the supporting section 32 having the outer dimension approximately 100 mm×60 mm.

The pad conditioner 30 was used to condition the polishing pad (the foamed polyurethane pad, IC 1000 (X-Y Groove Type single layer) manufactured by Nitta Haas Incorporated.) on the polishing apparatus (ChaMP232: manufactured by Tokyo Seimitsu Co., Ltd.). A silicon oxide film wafer (P-TEOS) was used as a dummy wafer and famed silica slurry SS25 (manufactured by Cabot Corporation) was used as slurry. The conditioning was performed for 1 minute at the polishing pressure 4 psi and the number of the platen rotation was set 80 rpm. The pad conditioning was performed as an interval conditioning with scanning and the interval of the pad conditioning was set 1 minute.

The test conditioning with the conventional plate was done for comparison. The conventional conditioning was performed with the plate having the diameter 4 inches, the diamond abrasive particle size #100 and the load condition was set at 39.4N. The condition of the pad conditioning was performed with rotational scanning.

First, the scrapes sizes of each polishing pad which was generated by the conditioning of the present invention with the above described conditions and the conditioning of the conventional plate type pad conditioner with the above described conditions were observed.

Figure 14:
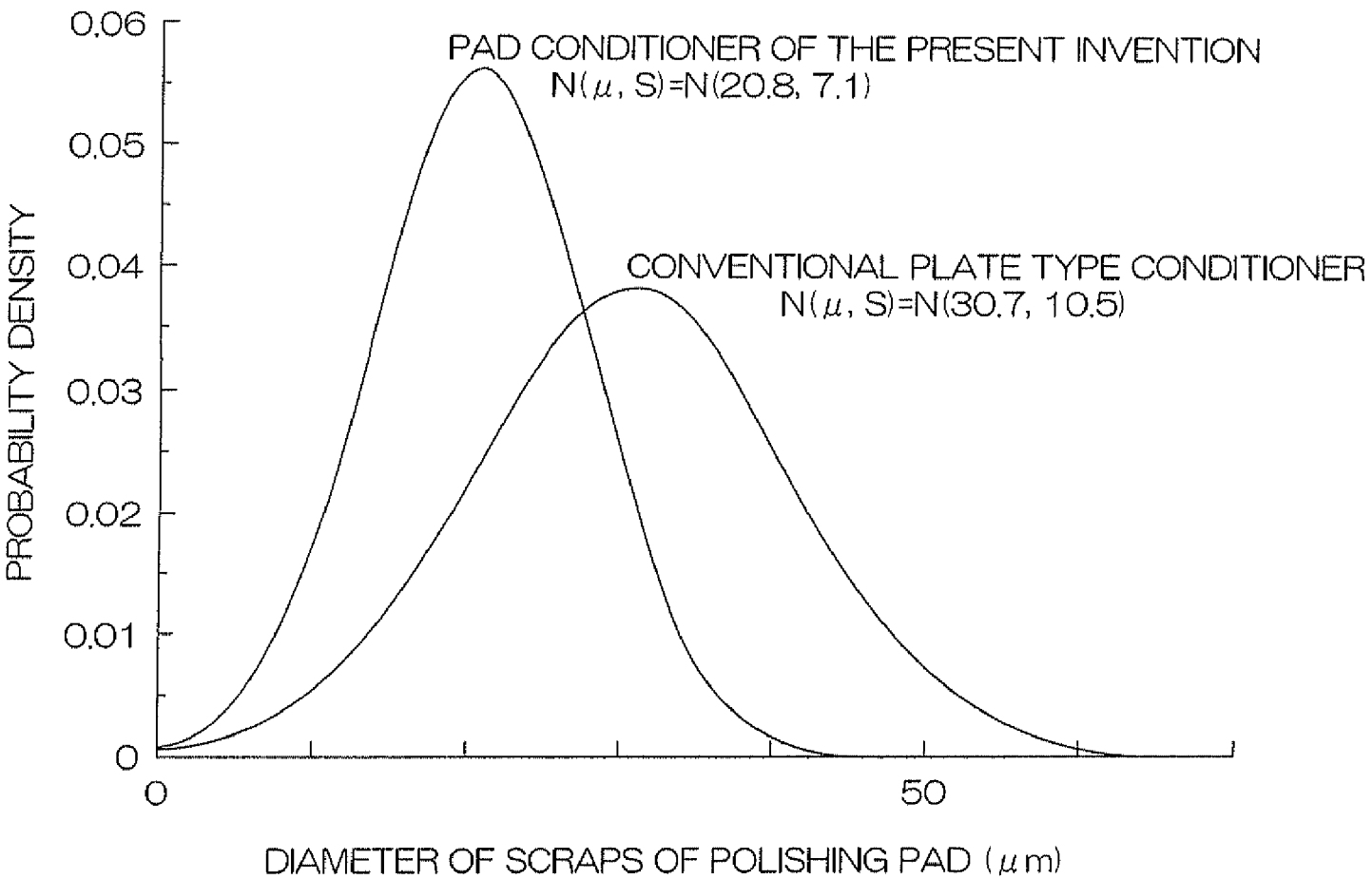
FIG. 14 is a graph to show the scrapes size of the polishing pad in the pad conditioning.

As a result of the observation, the scrapes size with the conventional plate type pad conditioner was the average of 30.7 μm and standard deviations of 10.5 μm and the scrapes size with the present invention was the average of 20.8 μm and standard deviations of 7.1 μm as shown in FIG. 14. Therefore, the present invention provided smaller scrapes and smaller variations in the size of scrapes.

It was determined that the pad conditioner of the present invention finely scraped the surface of the polishing pad based on the result above, unlike with the conventional pad conditioner such as a nylon brush scraping a by-product material off from the surface of the polishing pad. It was also determined that the scrapes size of the polishing pad in the present invention was much finer and the variations in the size were smaller in comparison with the conventional plate type pad conditioner. The result was obtained because each cutting edge of the pad conditioner in the present invention conditioned the polishing pad by continually contacting at the constant pressure. The conditioning with the conventional nylon brush was performed for comparison but the fine scrapes were not observed.

Figure 15:
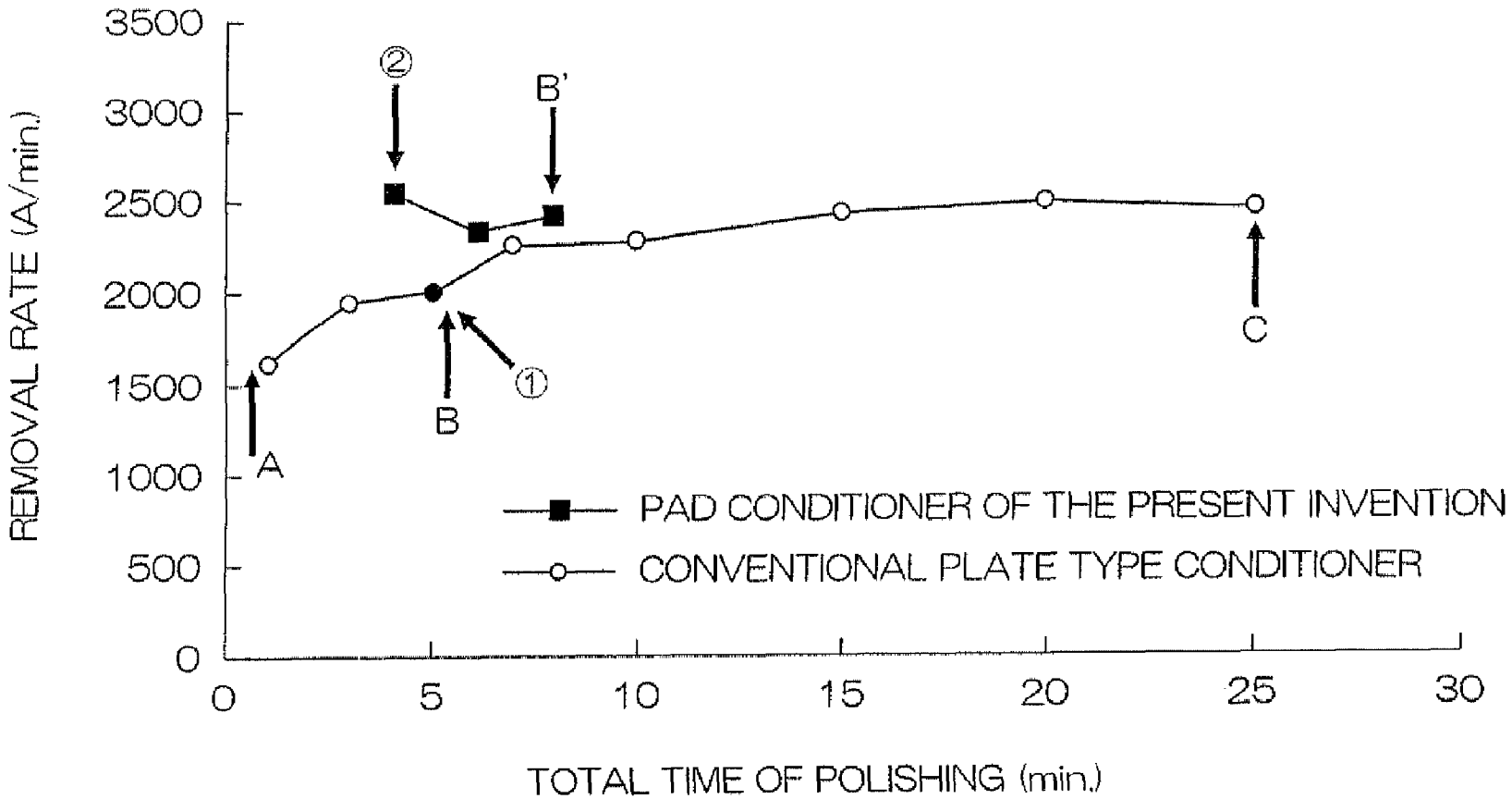
FIG. 15 is a graph to compare the startup time of the polishing pads.

Next, the startup time of the conventional plate type pad conditioner and the conditioner of the present invention of the polishing pad was compared. As a result of the comparison, the conventional plate type conditioner was used 15 (15 minutes) until stabled the polishing rate and the conditioner of the present invention was used 4 (4 minutes) to reach the predetermined polishing rate 2500 A/min after the startup as shown in FIG. 15.

Figure 16:
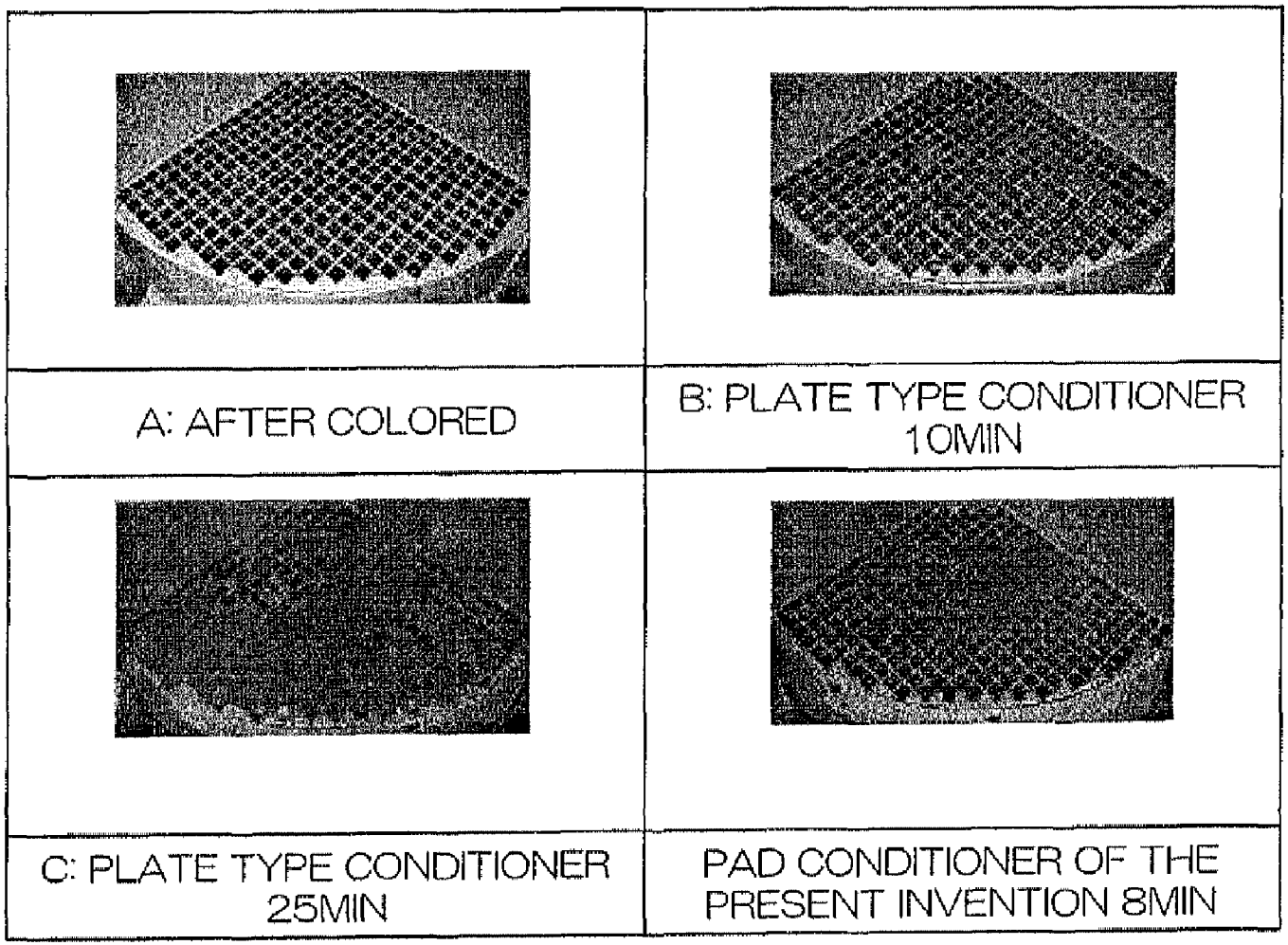
FIG. 16 is a graph to show the scrapes size of the polishing pad in the pad conditioning.

Subsequently, the conditioning ununiformity across the polishing pad surface was compared. As a result of evaluating the conditioning ununiformity in the colored polishing pad as shown in FIG. 16, the colored substance of the polishing pad was removed evenly across the polishing pad surface, and thereby it was determined that the conditioning of the polishing pad was performed evenly.

Figure 17:
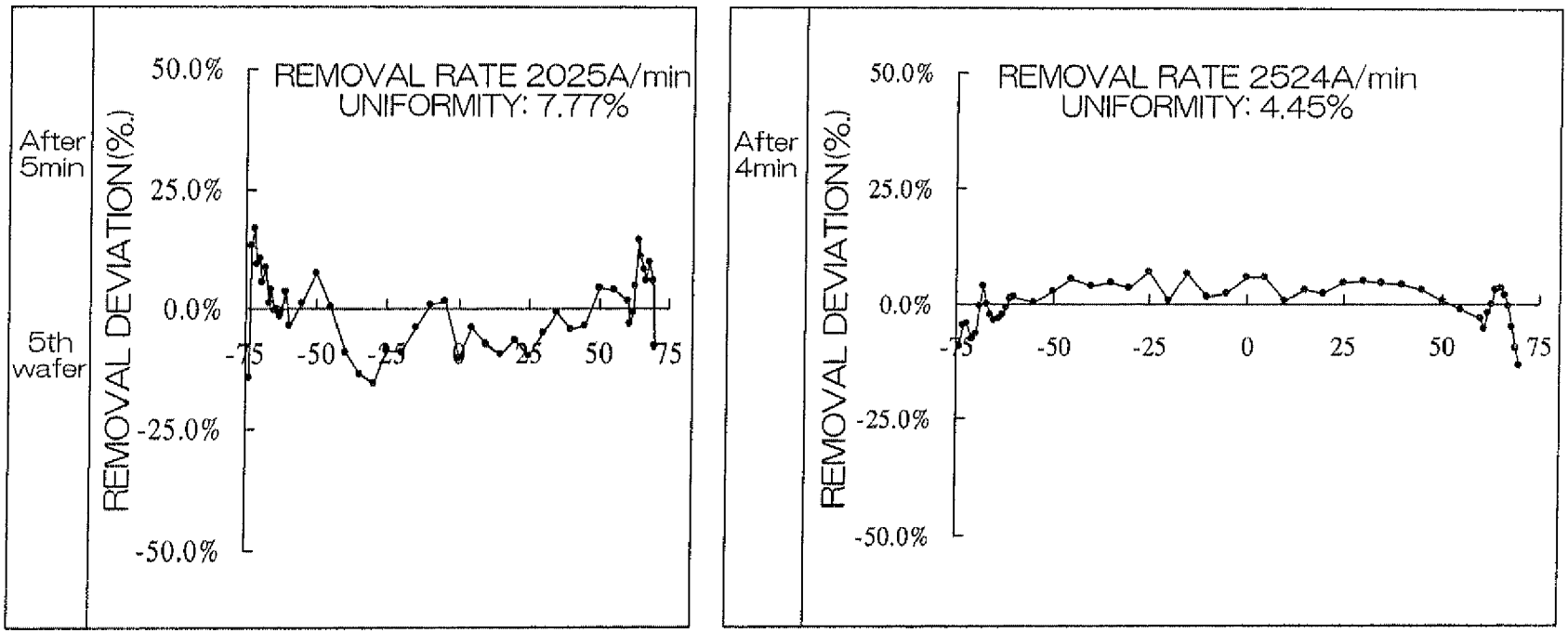
FIG. 17 is a graph to compare the polishing shape in the startup process of the polishing pads.

Further, the shape of the polishing pad surface was compared. While there was noticeable ununiformity in a radius direction across the surface of the wafer by using the conventional plate type pad conditioner, there was small ununiformity in a radius direction by using the pad conditioner of the present invention as shown in FIG. 17. In this way, the reduction of the ununiformity obtained by the uniform conditioning in the present invention was verified.

Secondly, examples of the pad conditioner 30 in the second embodiment will be described below. A circular plate of SUS304 material having a diameter of 150 mm was used as the supporting section 32. The elastic member 31 was made of SUS304 material having a diameter of 0.3 mm and an effective length of 10 mm, and a diamond abrasive particle (particle size #60) was electro-deposited to the vicinity of the tip end of the elastic member 31 as the tip piece 33. About 15000 elastic members 31 to which diamond abrasive particles were electro-deposited were fixed into the circular plate of the supporting section 32.

The above pad conditioner 30 was used to condition a polishing pad made of foamed polyurethane which had a surface stained with color. The process of conditioning was performed to obtain a surface roughness Ra of 0.4 μm to 0.6 μm at a rotation frequency of the polishing pad 20 of 30 rpm and a rotation frequency of the pad conditioner 30 of 80 rpm.

Figure 9:
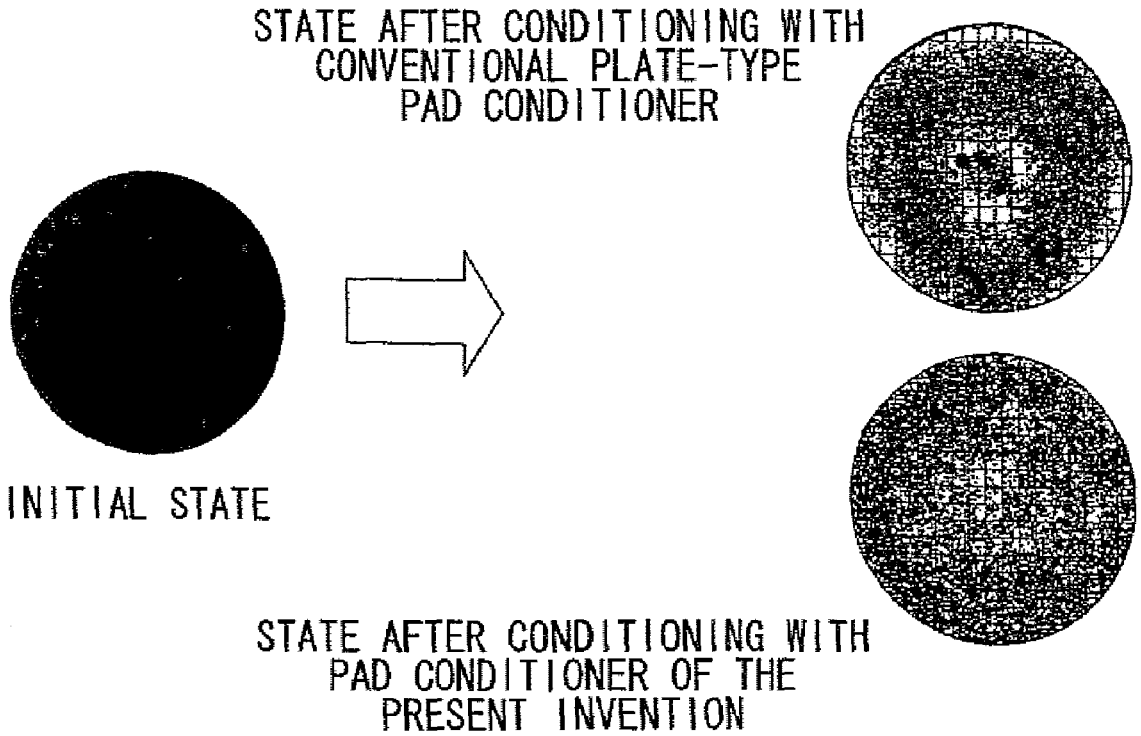
FIG. 9 is a view to compare uniformities of pad conditioning.

FIG. 9 shows the result of the above pad conditioning, and the result indicates that the surface of the polishing pad 20 was conditioned more uniformly compared to the case with a conventional pad conditioner which discontinuously contacts a surface of a polishing pad.

A pad conditioning was performed during a polishing of a dummy wafer (in-situ conditioning) in a polishing apparatus 10 equipped with the pad conditioner 30, and an operation of the polishing pad 20 was started up.

Figure 10:
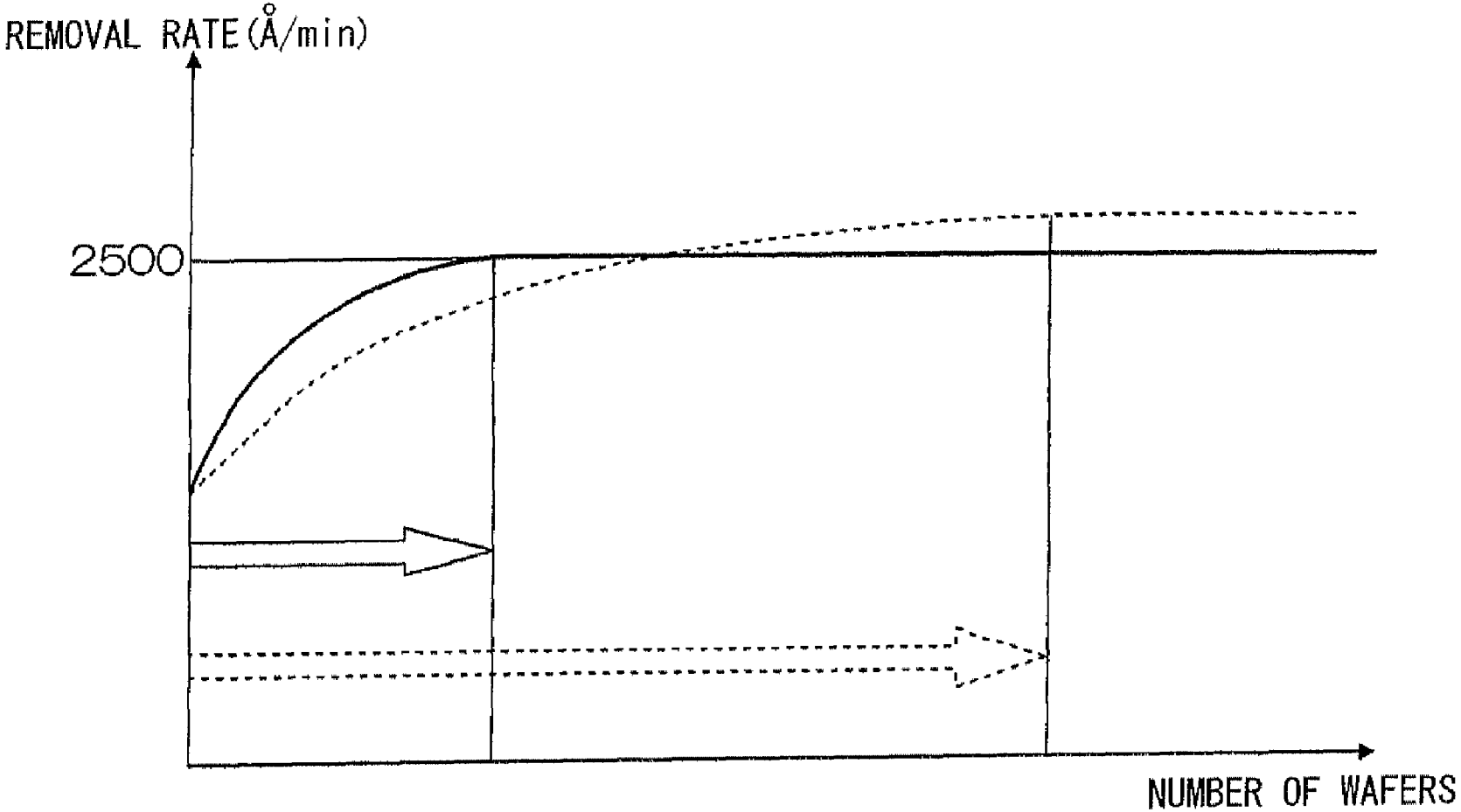
FIG. 10 is a graph to compare the startup time of the polishing pads.
Figure 11:
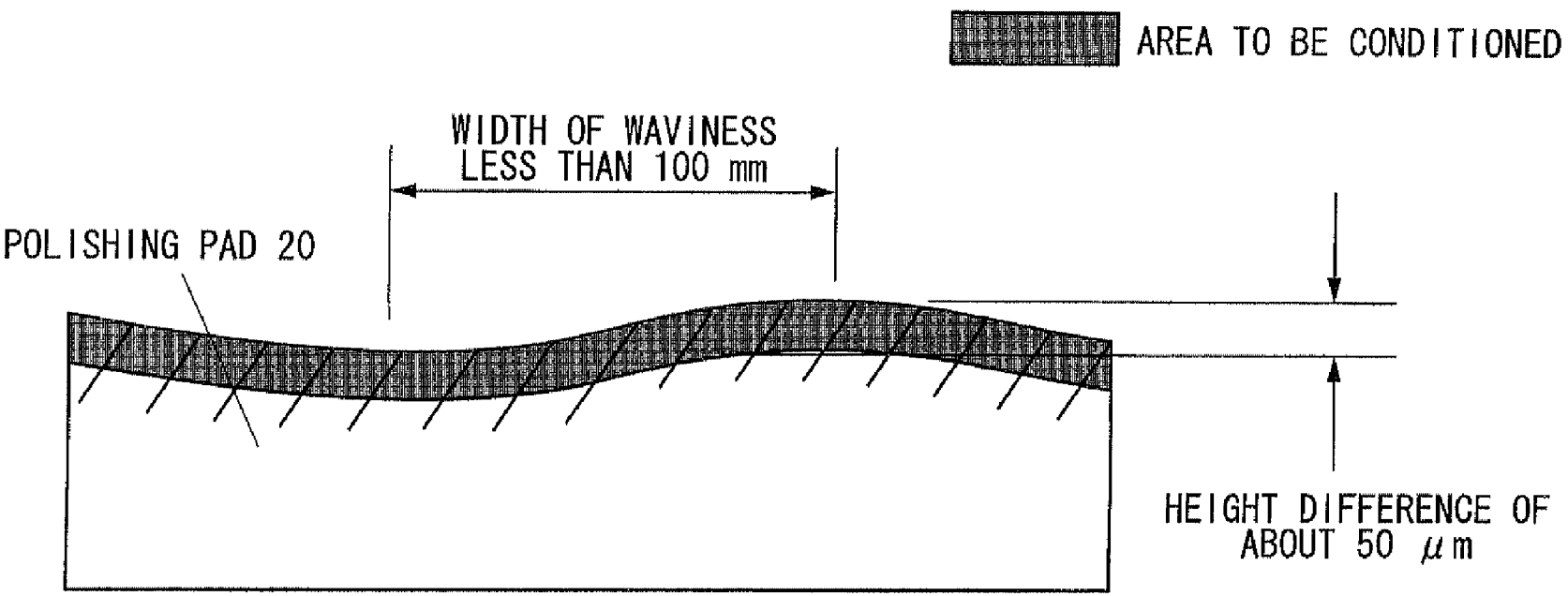
FIG. 11 is a view to illustrate a concept of pad conditioning required for CMP.
Figure 12:
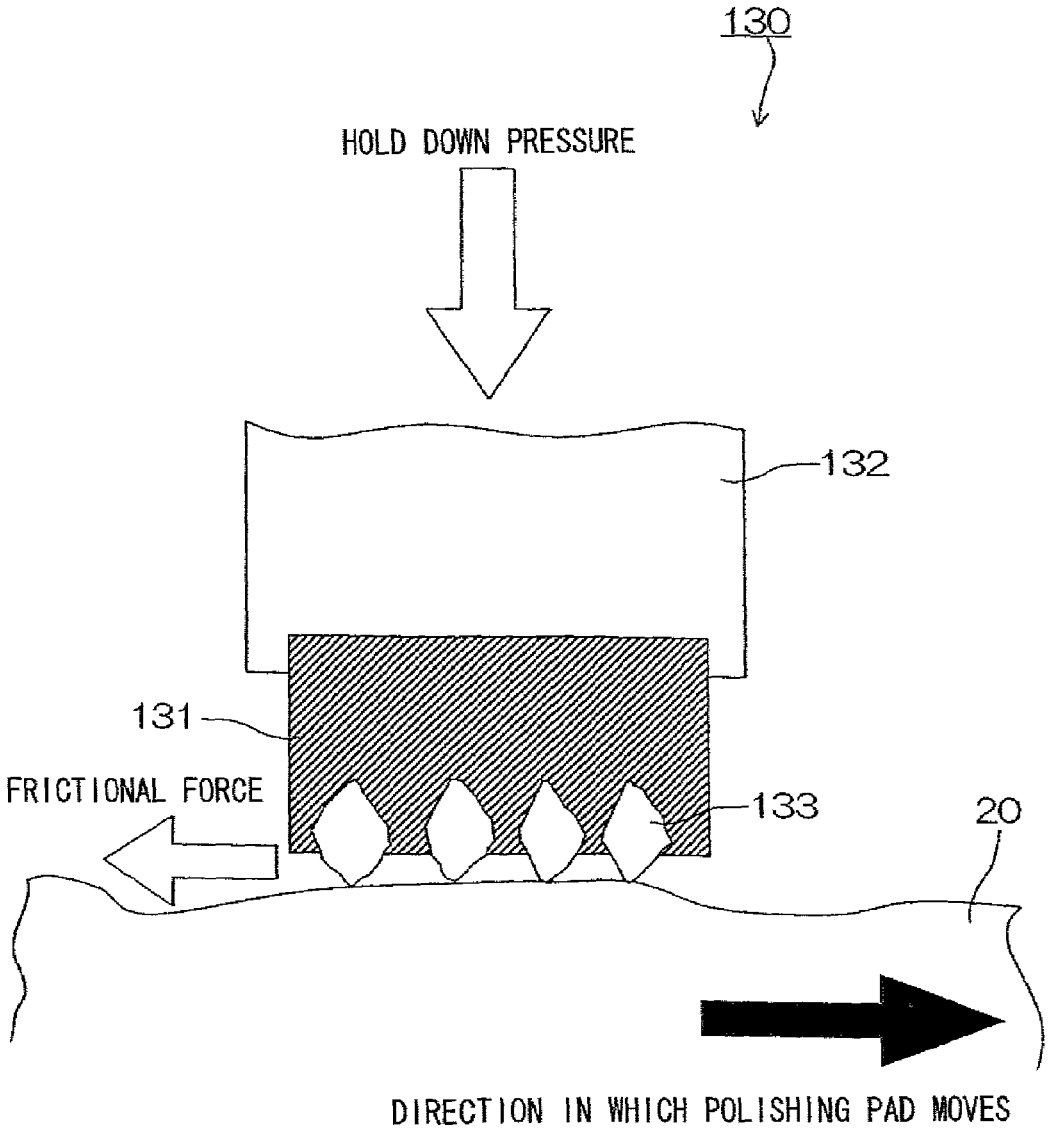
FIG.12 RELATED ART
FIG. 12 is a conceptual view to show a configuration of a conventional pad conditioner.
Figure 13:
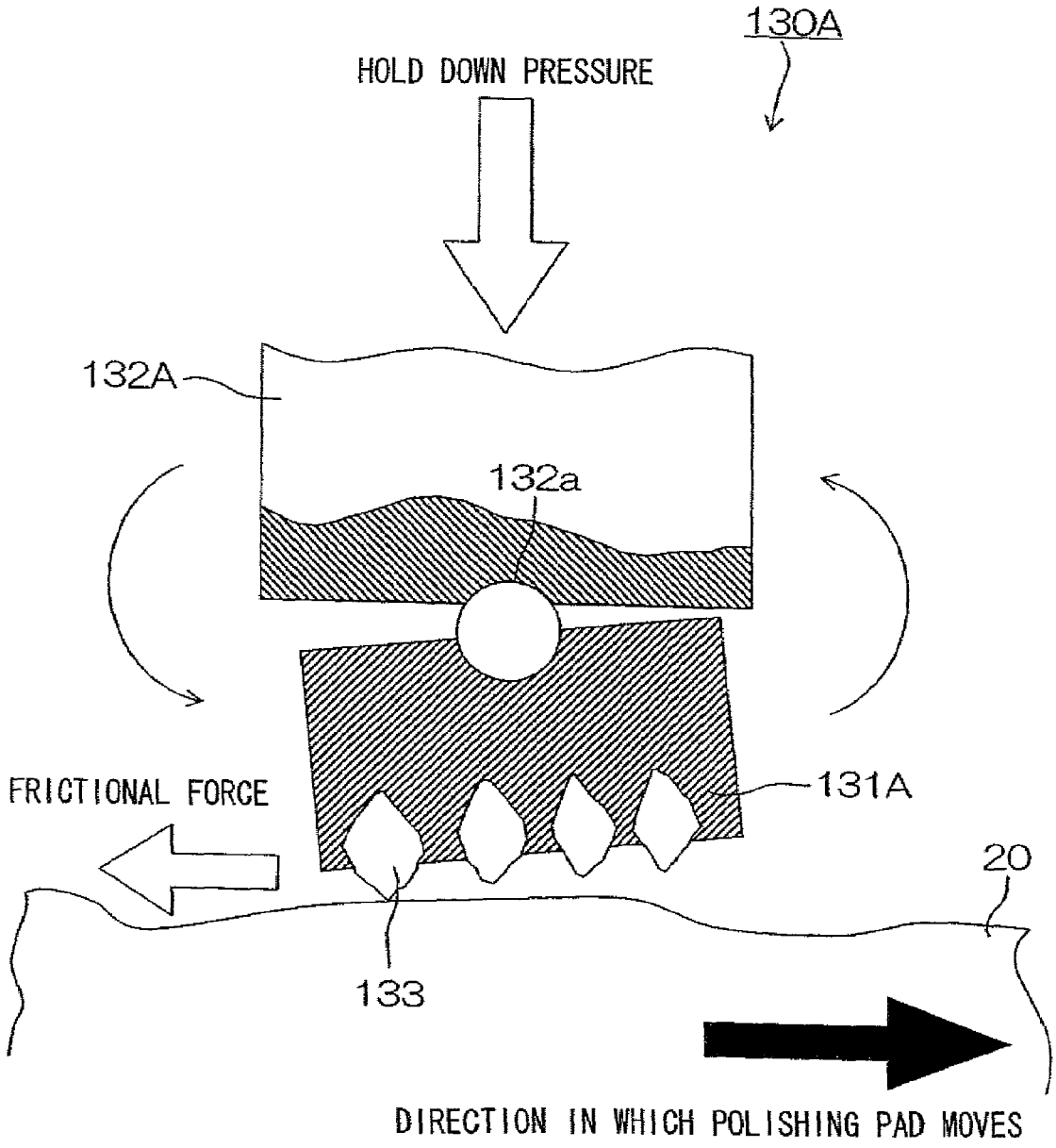
FIG.13 RELATED ART
FIG. 13 is a conceptual view to show a configuration of another conventional pad conditioner.

FIG. 10 is a graph to compare the startup of a conventional pad conditioner and the startup of the pad conditioner 30 of the present invention. In FIG. 10, the horizontal axis represents the number of wafers, and the vertical axis represents removal rates (A/min). The startup curve by the conventional pad conditioner is shown as a dotted line, and the startup curve by the pad conditioner 30 of the present invention is shown as a solid line. The graph shows that the startup time of the pad conditioner 30 of the present invention is reduced to about one third of the startup time of the conventional pad conditioner.

In a pad conditioning, a slurry supply nozzle is preferably provided to supply slurry along the elastic members 31 (plate spring 31A, piano wire 31B, carbon fiber 31C), which makes the pad conditioning more effective.

As described above, according to the pad conditioner 30 and the pad conditioning method of the present invention, when the elastic member 31 elastically deforms, the bending of the elastic members 31 creates a conditioning pressure, and this makes the elastic member 31 follows a waviness of a surface of the polishing pad 20 to condition the pad 20, and a uniform pad conditioning along the surface of the polishing pad 20 can be achieved.

Since the elastic member 31 is divided into a plurality of individual members, even if some individual members discontinuously contact the polishing pad 20 like a stick-slip motion, as the entire elastic member 31, at any time, some of the plurality of members are in contact with the polishing pad 20 to condition the polishing pad 20, which achieves a uniform pad conditioning along a surface of the polishing pad 20.

Also, according to the polishing apparatus 10 of the present invention, since the polishing apparatus 10 includes a pad conditioner which is able to uniformly condition a polishing pad along a surface of the pad, a process on a work can be well achieved with excellent removal rate uniformity across a work surface.

Moreover, according to the pad preparation method and the pad preparation apparatus 40 of the present invention, a polishing pad 20 can be optimized as an initial state in a short time of period.

What is claimed is:

1. A pad conditioner for dressing a surface of a polishing pad which is used in a polishing apparatus for polishing works, comprising:

a bending or deflecting or elastic member having a base end and a tip end located opposite the base end for contacting the polishing pad; and a supporting section to support the base end of the bending or deflecting or elastic member, wherein the bending or deflecting or elastic member is comprised of a plurality of rows of elongated bending or deflecting or elastic elements; wherein a separate tip piece is fixed to the vicinity of the tip end of the bending or deflecting or elastic member, and the tip piece is coated with a material having a high hardness and wear resistance;

wherein upon contact of a tip end portion of the bending or deflecting or elastic member with the polishing pad, the bending or deflecting or elastic member elastically deforms, so that a pad conditioning of the polishing pad is performed by scraping off a surface of the polishing pad with the tip end portion of the bending or deflecting or elastic member pressed against the surface of the polishing pad at a predetermined pad conditioning pressure.

2. The pad conditioner according to claim 1, wherein the bending or deflecting or elastic member is a metal brush.

3. The pad conditioner according to claim 1, wherein the bending or deflecting or elastic member is a thin plate to the tip end portion of which a plurality of the tip pieces are fixed.

4. The pad conditioner according to claim 1, wherein each of the elongated bending or deflecting or elastic elements is a thin plate to the tip end portion of which a plurality of the tip pieces are fixed.

5. The pad conditioner according to claim 3, wherein the tip end of the bending or deflecting or elastic member has a plurality of notches formed therein toward to the base end, so that the tip end is divided into a plurality of portions.

6. The pad conditioner according to claim 4, wherein the tip end of the bending or deflecting or elastic member has a plurality of notches formed therein toward to the base end, so that the tip end is divided into a plurality of portions.

7. The pad conditioner according to claim 1, wherein each of the elongated bending or deflecting or elastic elements comprises a group of a plurality of linear bodies.

8. The pad conditioner according to claim 1, wherein each of the elongated bending or deflecting or elastic elements comprises a group of a plurality of linear bodies.

9. The pad conditioner according to claim 4 wherein the tip pieces are fixed on only one side of the tip end portion.

10. The pad conditioner according to claim 4 wherein a the tip pieces are fixed on a free end of the tip end portion as an extension thereof.

11. The pad conditioner according to claim 1, further comprising a pressure regulating device which regulates a pad conditioning pressure by moving the supporting section to or away from the polishing pad and adjusting a bending of the bending or deflecting or elastic member.

12. The pad conditioner according to claim 11, wherein the supporting section includes a first supporting body for fixing the base end of the bending or deflecting or elastic member thereto, and a second supporting body which is mounted to the first supporting body movably to and from the first supporting body for limiting the position of the bending or deflecting or elastic member in a plane parallel to the polishing pad, and the bending or deflecting or elastic member has an effective flexible length which is adjustable by moving the second supporting body to or away from the first supporting body.

13. A polishing apparatus, comprising:

a polishing plate mounted on a rotatable shaft and supporting a polishing pad; and a pad conditioner for dressing a surface of the polishing pad, the pad conditioner comprising:

a bending or deflecting or elastic member having a base end and a tip end located opposite the base end for contacting the polishing pad; and a supporting section to support the base end of the bending or deflecting or elastic member, wherein the bending or deflecting or elastic member is comprises of a plurality of rows of elongated bending or deflecting or elastic elements; wherein a separate tip piece is fixed to the vicinity of the tip end of the bending or deflecting or elastic member, and the tip piece is coated with a material having a high hardness and wear resistance;

wherein upon contact of a tip end portion of the bending or deflecting or elastic member with the polishing pad, the bending or deflecting or elastic member elastically deforms, so that a pad conditioning of the polishing pad is performed by scraping off a surface of the polishing pad with the tip end portion of the bending or deflecting or elastic member pressed against the surface of the polishing pad at a predetermined pad conditioning pressure.

* * * * *